US006014917A

United States Patent [19]

Bally et al.

[11] Patent Number: 6,014,917

[45] Date of Patent: Jan. 18, 2000

[54] SELF-ADJUSTING AND/OR SELF-LOCKING PLIERS

[75] Inventors: Alexander Bally, Pittsburgh; Eric R. Colburn, Wexford, both of Pa.

[73] Assignee: B!G Ventures, L.L.C., Pittsburgh, Pa.

[21] Appl. No.: 09/108,561

[22] Filed: Jul. 1, 1998

[51] Int. Cl.[7] ..... B25B 7/12

[52] U.S. Cl. ..... 81/355; 81/357; 81/409.5

[58] Field of Search ..... 81/91.1, 91.3, 81/355, 368, 370, 375, 426, 452, 454

[56] References Cited

U.S. PATENT DOCUMENTS

| | | | |
|---|---|---|---|
| Re. 32,614 | 3/1988 | Wilson . | |
| 1,417,756 | 5/1922 | McDonald . | |
| 1,651,216 | 11/1927 | McGill . | |
| 1,772,428 | 8/1930 | Palotce . | |
| 1,944,116 | 1/1934 | Stratman . | |
| 2,066,716 | 1/1937 | Cruickshank . | |
| 2,112,873 | 4/1938 | Wright . | |
| 2,564,585 | 8/1951 | Shaw . | |
| 2,620,697 | 12/1952 | Sarvie . | |
| 2,661,648 | 12/1953 | Jones . | |
| 2,778,259 | 1/1957 | Moir . | |
| 2,906,155 | 9/1959 | Miller | 81/343 |
| 3,116,656 | 1/1964 | Hostetter . | |
| 3,169,307 | 2/1965 | Langwell . | |
| 3,232,152 | 2/1966 | Miller . | |
| 3,257,878 | 6/1966 | Anderson . | |
| 3,354,759 | 11/1967 | Cook . | |
| 3,496,808 | 2/1970 | Schmidt . | |
| 3,600,986 | 8/1971 | Baldwin . | |
| 3,657,948 | 4/1972 | Myers . | |
| 3,803,954 | 4/1974 | Lenker . | |
| 4,094,215 | 6/1978 | Hudson . | |
| 4,499,797 | 2/1985 | Wilson . | |
| 4,651,598 | 3/1987 | Warheit . | |
| 4,662,252 | 5/1987 | Warheit . | |
| 4,802,390 | 2/1989 | Warheit . | |
| 4,893,530 | 1/1990 | Warheit | 81/409.5 |
| 4,922,770 | 5/1990 | Dlugolecki et al. . | |
| 5,020,399 | 6/1991 | Annis et al. . | |
| 5,033,338 | 7/1991 | Ford, Jr. . | |
| 5,056,385 | 10/1991 | Peterson . | |
| 5,060,543 | 10/1991 | Warheit . | |
| 5,140,876 | 8/1992 | Fields . | |
| 5,233,893 | 8/1993 | Schmidt | 81/368 |
| 5,351,584 | 10/1994 | Warheit . | |
| 5,351,585 | 10/1994 | Leseberg | 81/426 |
| 5,385,072 | 1/1995 | Neff . | |
| 5,435,214 | 7/1995 | Sisson . | |
| 5,609,080 | 3/1997 | Flavigny | 81/368 |
| 5,660,089 | 8/1997 | Chow . | |

FOREIGN PATENT DOCUMENTS

WO 98/53957 12/1998 WIPO .

*Primary Examiner*—James G. Smith
*Assistant Examiner*—David B. Thomas
*Attorney, Agent, or Firm*—Arnold B. Silverman; Benjamin T. Queen, II; Eckert Seamans Cherin & Mellott, LLC

[57] ABSTRACT

Self adjusting pliers for grasping a workpiece include first and second plier members each including a handle portion, a jaw portion, and an intermediate portion therebetween. The self-adjusting pliers include a first pivot pin about which the first and second plier members pivot permitting the jaw portions to converge on a workpiece and grasp the workpiece in response to initial movement of the handle portions toward each other. The self adjusting pliers further include a second pivot pin about which the pliers pivot once pivoting has been terminated about the first pivot pin so as to permit a further grasping force to be applied to the workpiece in response to continued movement of the handle portions toward each other. The second pivot pin is closer to the jaw portions than the first pivot pin to allow for a greater mechanical advantage to be obtained. The self adjusting pliers also include a biasing spring for biasing the handle portions away from each other and the jaw portions away from each other. Self-locking pliers are also provided, either in combination with the self-adjusting pliers or individually, for automatically locking the jaw portions into engagement with a workpiece.

14 Claims, 21 Drawing Sheets

SELF-ADJUSTING AND/OR SELF-LOCKING PLIERS

BACKGROUND OF THE INVENTION

1. Field of the Invention

The present invention relates generally to utility pliers and, more particularly to self-adjusting pliers that self-adjust for grasping a workpiece and/or self-locking pliers for automatically locking the pliers into engagement with the workpiece.

2. Description of the Prior Art

Many types of handheld utility pliers are known in the art. Conventional pliers typically include two plier members interconnected in a scissor-like arrangement allowing for a workpiece to be grasped by jaw portions of the pliers in response to movement of handle portions of the pliers. Over the years, numerous improvements have been made to the conventional plier design in order to obtain a better and more efficient plier. For example, self-adjusting pliers have been developed in order to provide a set of pliers that more easily adjust to the size of a given workpiece. In addition, self-locking pliers have been developed in order to provide a set of pliers that will allow the pliers to remain in locking engagement with the workpiece.

U.S. Pat. No. 4,651,598 discloses a self-adjusting utility plier. These pliers provide for self-adjustment through employment of a spring-biased control arm positioned between the handles. During the self-adjustment, the pivot point of the pliers lies in the spring-biased control arm. As can be appreciated, the location of the pivot point is continuously changing until such time as the workpiece is engaged resulting in the center of the pawl member becoming the main pivot point. A disadvantage of such an arrangement is the lack of controlled, rotating movement inherent in the arrangement of the continuously changing initial pivot point. This produces slack in the pliers which may lead to unpredictable pawl engagement between the pawl member and cooperating rack. Another disadvantage of the compound movement inherent in the control arm linkage and its continuously changing location of the pivot point, as opposed to a simple pivoting movement around a fixed pivot point, is the requirement for generous clearance between the moving parts of the pliers. Consequently, when the teeth of the pawls and the mating teeth come into engagement as a result of clamping force applied to the handles, a different set of teeth may become engaged at different times in essentially identical clamping operations resulting in unpredictable clamping performance. Consequently, excessive slack within the linkage-based mechanism has to be taken up each time an object is grasped and a significant portion of the handle movement is dissipated before clamping forces are being applied to the workpiece. This limits the separation of the jaws for a given handle spacing, limiting the size of object that can be grasped. Conversely, to achieve a larger jaw opening for grasping larger objects, the handle spacing becomes excessive for one-handed operation of the pliers. In addition, the main pivot point is located inside of a pawl which is itself inside of an elongated channel or slot. A disadvantage of this arrangement is that this limits how close the main pivot point can be located to the jaws and thus, the ultimate leverage that can applied by squeezing the handles is limited. Similar self-adjusting utility pliers are disclosed in U.S. Pat. Nos. 4,662,252, 4,802,390, 4,893,530, 5,060,543 and 5,351,584.

U.S. Pat. No. 5,140,876 discloses variable-fulcrum pliers. The pliers initially pivot about a fixed pivot pin until the jaws of the pliers grip a solid object. The jaws then become the fulcrum which causes the pivot point to shift to a fixed pivot lug which acts as the fulcrum of the pliers as additional pressure is applied to the handle portions of the pliers. In this arrangement, the two pivot points are aligned transversely to the longitudinal axis of the pliers. A disadvantage of this arrangement is that there is not rapid self-adjustment with minimum handle movement during the adjustment cycle. A further disadvantage is that by transversely aligning the pivot points with respect to the longitudinal axis of the pliers, the maximum leverage during the clamping cycle is not obtained.

As to self-locking pliers, the most common self-locking plier is the well-known VISE-GRIP pliers. VISE-GRIP pliers employ a toggle mechanism which allows for the jaws to be maintained in locking engagement with a workpiece once a force is applied to the handle members of the pliers. Typically, VISE-GRIP pliers include an adjustment screw which must be initially adjusted to set the opening of the jaws in relation to the workpiece to be grasped. As can be appreciated, operation of the VISE-GRIP pliers requires several steps and further requires that the user employ both hands to operate the same. Examples of the well-known VISE-GRIP pliers are disclosed in U.S. Pat. Nos. 3,354,759, 3,496,808, 5,056,385 and 5,435,214.

Still other pliers have been developed which include a combination of the self-adjusting and self-locking features. Such pliers are disclosed in, for example, U.S. Pat. Nos. 1,772,428, 1,944,116 and 2,620,697. The pliers disclosed in these patents utilize an arcuate arm positioned between the handle members of the pliers and employ a clutch arrangement or friction arrangement for adjusting and/or locking the pliers as the handle members are moved toward each other. These type pliers do not provide for a wide range of self-adjustment and the mechanisms employed therein are difficult to operate and require both hands of the user to for operation.

There remains a need for improved self-adjusting and/or self-locking handheld utility pliers which provide a greater mechanical advantage than previously known pliers and which can be easily operated by the user, preferably with one hand.

SUMMARY OF THE INVENTION

The present invention has met the above-described needs by providing for improved self-adjusting and/or self-locking pliers.

The self-adjusting pliers for grasping a workpiece include first and second plier members each including a handle portion, a jaw portion, and an intermediate portion therebetween. First pivot means are provided on the intermediate portions permitting the jaw portions to converge on the workpiece and grasp the workpiece in response to initial movement of the handle portions toward each other. In addition, second pivot means are provided on the intermediate portions permitting a further grasping force to be applied to the workpiece in response to continued movement of the handle portions toward each other. The second pivot means is positioned closer to the jaw portions than the first pivot means. Advantageously, this allows for a greater mechanical advantage to be obtained. The self-adjusting pliers also include a biasing means, such as, for example, a compression spring positioned between the handle portions and secured to the handle portions, for biasing the handle portions away from each other and the jaw portions away from each other.

The first pivot means includes a first pivot pin attached to the intermediate portion of the second plier member and a positioning slot formed in the intermediate portion of the first plier member. The positioning slot has a generally arcuate portion and a shifting slot portion in communication therewith. The first pivot pin is slidably received in the positioning slot.

In a preferred embodiment, the first pivot pin is positioned in the shifting slot portion of the positioning slot during the initial movement of the handle portions toward each other to grasp the workpiece. Also, in the preferred embodiment, the second pivot means includes a second pivot pin attached to the intermediate portion of the first plier member and a generally arcuate main rack on the intermediate portion of the second plier member. The generally arcuate main rack has a plurality of notches where the second pivot pin is in engagement with one of the plurality of notches during the continued movement of the handle portions toward each other to apply the further grasping force to the workpiece. Advantageously, the generally arcuate main rack allows for the second pivot pin to be in engagement therewith at a location close to the jaw portions of the pliers. This allows for a greater mechanical advantage to be obtained during the continued movement of the handle portions toward each other to apply the further grasping force to the workpiece. When the second pivot pin is in engagement with one of the plurality of notches of the generally arcuate main rack and, during the continued movement of the handle portions toward each other to apply the further grasping force to the workpiece, the first pivot pin moves from the shifting slot portion of the positioning slot to the generally arcuate portion thereof.

In a further embodiment, the second pivot means includes a translating pawl pivotally secured by a translating pawl pivot pin to the intermediate portion of the first plier member and a generally arcuate translating rack formed on the intermediate portion of the second plier member. The generally arcuate translating rack includes a plurality of first teeth and the translating pawl includes a plurality of second teeth formed on a first side thereof adjacent the generally arcuate translating rack. The plurality of second teeth are in engagement with the plurality of first teeth of the generally arcuate translating rack during the continued movement of the handle portions toward each other to apply the further grasping force to the workpiece.

In another embodiment, the second pivot means further includes a stop member and a spring for urging the translating pawl into a concentric relationship with the generally arcuate translating rack. The stop member is preferably formed on the intermediate portion of the first plier member and positioned for contacting a second side of the translating pawl. The spring includes one end connected to the intermediate portion of the first plier member and another end connected to the translating pawl for urging the translating pawl away from the generally arcuate translating rack and into contact with the stop member. Advantageously, this positions the translating pawl concentrically to the translating rack and allows for simultaneous engagement of all teeth of the translating pawl and, therefore, better and more precise engagement between the translating pawl and the generally arcuate translating rack because of the constant concentric relationship therebetween.

In yet another embodiment the second pivot means includes a rachet pawl pivotally secured by a rachet pawl pivot pin to the intermediate portion of the first plier member and a generally arcuate rachet rack formed on the intermediate portion of the second plier member. The generally arcuate rachet rack includes a plurality of first teeth and the rachet pawl includes a plurality of second teeth formed on a portion of a first side thereof adjacent the generally arcuate rachet rack. The plurality of second teeth are in engagement with the plurality of first teeth of the generally arcuate rachet rack during the initial movement of the handle portions toward each other to grasp the workpiece and during the continued movement of the handle portions toward each other to apply the further grasping force to the workpiece. In this embodiment, the first pivot means includes a first pivot pin fixedly secured to the intermediate portion of the second plier member and a generally arcuate positioning slot formed in the intermediate portion of the first plier member where the first pivot pin is slidably received in a generally arcuate positioning slot. The second pivot means further includes engagement means for maintaining the plurality of second teeth of the rachet pawl in continuous engagement with the plurality of first teeth of the generally arcuate rachet rack during the initial movement and the continued movement of the handle portions toward each other. By providing for the engagement means, it is not necessary to form the generally arcuate positioning slot so as to include a shifting slot portion, as in previous embodiments described herein.

The engagement means also includes disengagement means for disengaging the plurality of second teeth of the rachet pawl from the plurality of first teeth of the generally arcuate rachet rack to allow the handle portions to move away from each other and the jaw portions to move away from each other.

In accordance with another aspect of the invention, self-locking pliers for grasping a workpiece are also provided. The self-locking pliers include first and second plier members each including a handle portion, a jaw portion and an intermediate portion therebetween. Fixed pivot means are provided on the intermediate portions for interconnecting the first and second plier members and permitting the jaw portions to converge on the workpiece and grasp the workpiece in response to movement of the handle portions toward each other. The self-locking pliers also include self-locking means for automatically locking the jaw portions. The self-locking means comprises cam means on the intermediate portions of the first and second plier members, the cam means including a cam rack pivotable between a first position where the handle portions and the jaw portions are extended away from each other and a second position where the jaw portions are converging towards each other. The cam rack includes a cam pin attached thereto. The self-locking means further comprises a biasing spring connected at one end to the cam rack and at the other end to the second plier member for urging the cam rack toward the first position. The self-locking means further comprises a cam slot formed in the intermediate portion of the first plier member with the cam pin being slidably received in the cam slot. The self-locking means also comprises lock pawl means on the intermediate portion of the second plier member adjacent the cam rack where the lock pawl means includes a lock pawl moveable between a locked position for engagement with the cam rack and an unlocked position for disengagement from the cam rack.

The self-locking pliers may also include clamping means for interacting with the cam means to apply an additional clamping force to the workpiece. The clamping means includes a pump lever pivotally connected to the intermediate portion of the second plier member, and a pump pawl pivotally connected to the pump lever and positioned adjacent the cam rack. The pump lever is structured to cause the pump pawl to engage the cam rack and pivot the cam rack toward the second position to apply the clamping force to the workpiece responsive to actuation of the pump lever. Advantageously, it will be appreciated that the self-locking means and the clamping means of the self-locking pliers may be easily operated by the user. Preferably, the self-locking pliers may be operated by one hand of the user thereby allowing for the user's other hand to be used for other purposes.

In another embodiment of the self-locking pliers, the self-locking pliers may also include self-adjusting means on the intermediate portions for interconnecting the first and second plier members and permitting the jaw portions to converge on the workpiece and grasp the workpiece in response to movement of the handle portions toward each other. The self-adjusting means further permit a grasping force to be applied to the workpiece in response to continued movement of the handle portions toward each other.

It is, therefore, an object of the present invention to provide selfadjusting pliers for grasping workpieces of different sizes.

It is also an object of the present invention to provide self-adjusting pliers which have enhanced mechanical advantage.

It is a further object of the present invention to provide self-adjusting pliers that can be easily and efficiently operated.

It is yet another object of the present invention to provide self-adjusting pliers that can be operated with one hand.

It is yet another object of the present invention to provide self-locking pliers for automatically locking the jaw portions of the pliers into engagement with a workpiece.

Still another object of the invention is to provide self-locking pliers that may be easily and efficiently operated.

It is another object of the invention to provide self-locking pliers that can be operated by the user with one hand.

It is a further object of the present invention to provide self-locking pliers that may apply an additional clamping force to the workpiece following the automatic locking of the jaw portions into engagement with the workpiece.

It is also an object of the present invention to provide pliers having both the capability for grasping the workpiece and for automatically locking the jaw portions into engagement with the workpiece.

It is an object of the present invention to provide pliers such that an unskilled person may operate the pliers in essentially the same manner as conventional pliers.

It is another object to provide locking pliers that are readily releasable from a locked position and easily reset for further operation.

These and other objects of the invention will be more fully understood from the following description of the invention with reference to the drawings appended hereto.

DESCRIPTION OF THE PREFERRED EMBODIMENT

Figure 1:
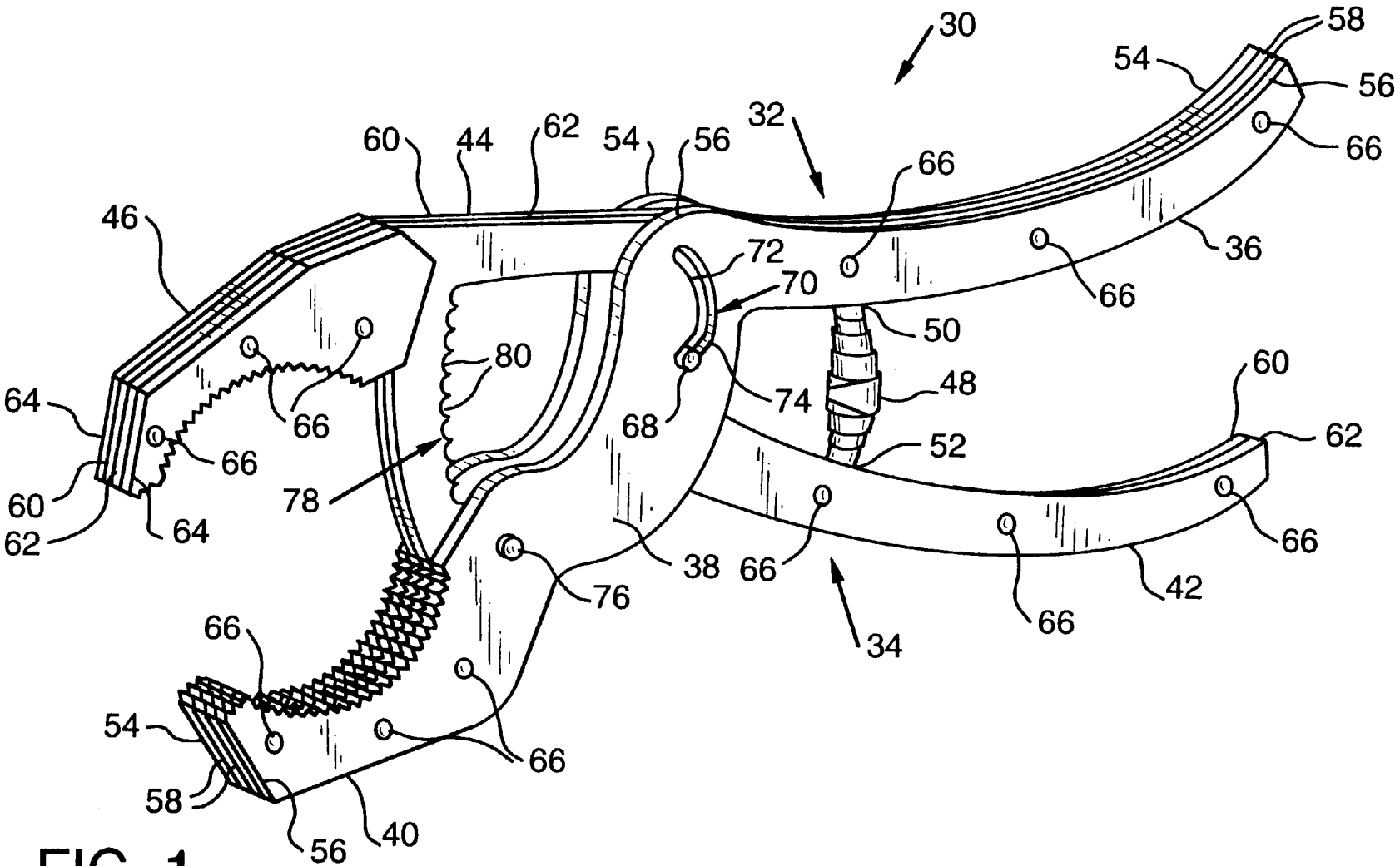
FIG. 1 is a perspective view of a preferred embodiment of the hand held utility pliers of the present invention.

Referring to FIGS. 1–9, there is shown a preferred embodiment of the self-adjusting pliers 30 of the present invention. The pliers 30 include a first plier member 32 and a second plier member 34 interconnected in a scissor-like arrangement in order to easily and efficiently adjust to the size of a given workpiece. The first plier member 32 includes a handle portion 36, an intermediate portion 38, and a jaw portion 40. Similarly, the second plier member 34 includes a handle portion 42, an intermediate portion 44, and a jaw portion 46.

Figures 2, 3, 4, 5, 6:
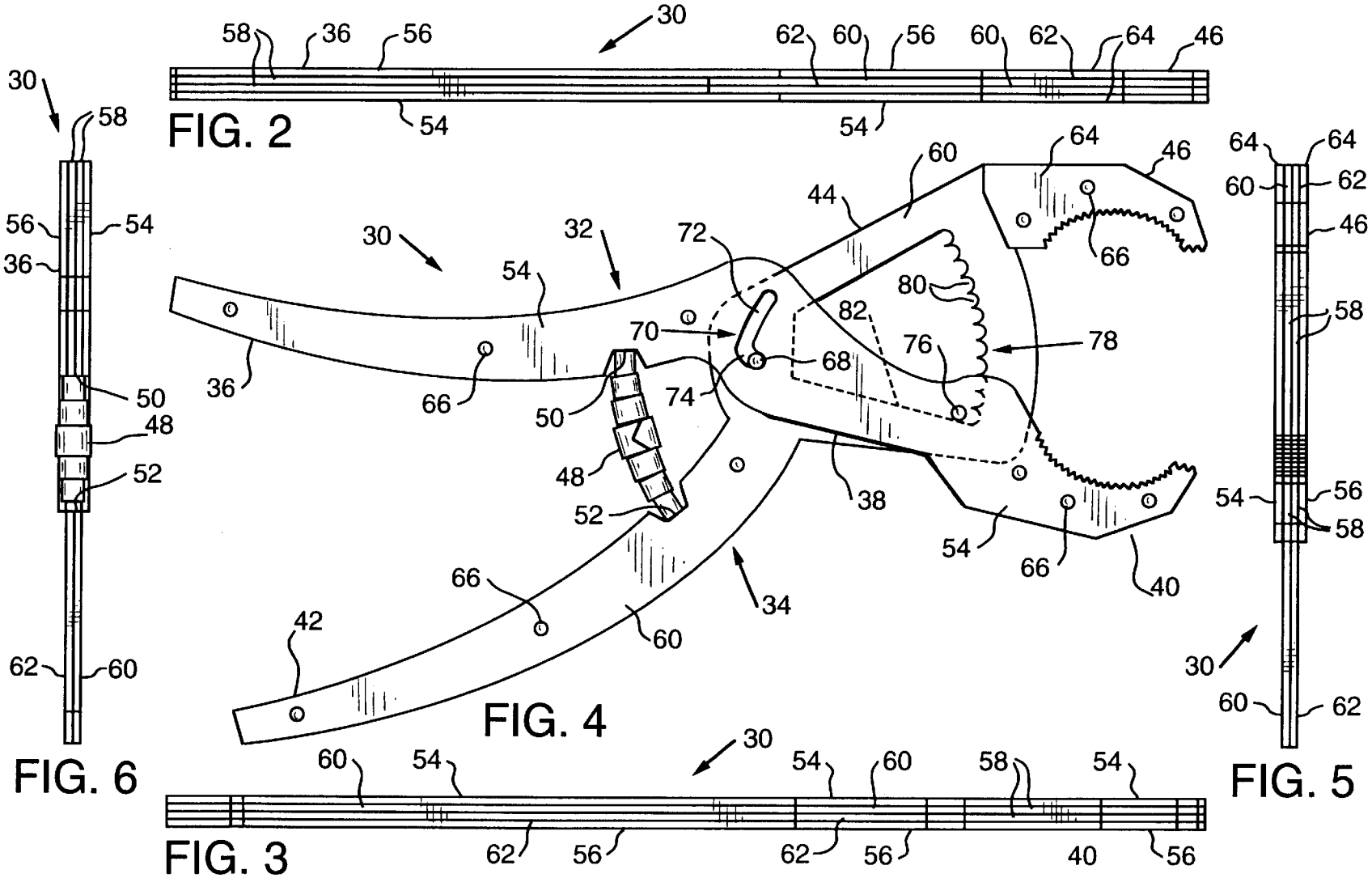
FIG. 2 is a top plan view of the pliers shown in FIG. 1.
FIG. 3 is a bottom view of the pliers shown in FIG. 1.
FIG. 4 is a side elevational view of the pliers shown in FIG. 1 in a fully open position, with the opposing side of the pliers shown in FIG. 1 being illustrated in FIG. 4.
FIG. 5 is a front view of the pliers shown in FIG. 1.
FIG. 6 is a rear view of the pliers shown in FIG. 1.

The pliers 30 include a biasing means, such as, for example, telescoping spring 48 for biasing the handle portions 36 and 42 away from each other and the jaw portions 40 and 46 away from each other such that the pliers 30 are in a fully open position (FIGS. 1 and 4). Preferably, the opposing ends 50 and 52 are secured to handle portions 36 and 42, respectively by, for example, the opposing ends 50 and 52 being received in recesses (not shown) formed in the handle portions 36 and 42, respectively, such that the spring is passively retained by its own spring action against the anchor points. In addition, the telescoping spring 48 may be secured to the handle portions 36 and 42 by other similar means which are generally known in the art. It is most important that the telescoping spring 48 provide the proper biasing action to bias the handle portions 36 and 42 away from each other and the jaw portions 40 and 46 away from each other. While telescoping spring 48 is illustrated on the preferred embodiment, it will be appreciated that other biasing means may be provided for maintaining the pliers 30 in a fully open position, such as a compression spring secured to the handle portions 36 and 42 or a tension spring connected between the handle portion 36 of the first plier member 32 and the jaw portion 46 of the second plier member 34, as will be described in more detail herein.

Referring specifically to FIGS. 1–3 and 5–6, the first plier member 32 and second plier member 34 are preferably formed of laminated construction. As shown, the first plier member 32 includes relatively spaced apart first and second outer laminations 54 and 56 which form the handle portion 36, the intermediate portion 38 and the jaw portion 40. Inner laminations 58, or other suitable filler material, are provided between the first and second outer laminations 54 and 56 to complete the handle portion 36 and the jaw portion 40. The second plier member 34 includes first and second inner laminations 60 and 62 that make up the handle portion 42, the intermediate portion 44 and the inner part of jaw portion 46. The jaw portion 46 also includes outer laminations 64 positioned on the outside of first and second inner laminations 60 and 62 to complete formation of the jaw portion 46. As best shown in FIG. 1, the first and second inner laminations 60 and 62 which make up the intermediate portion 44 of the second plier member 34, is slidably received between the first and second outer laminations 54 and 56 that make up the intermediate portion 38 of the first plier member 32. Advantageously, this arrangement allows for relative movement between the first plier member 32 and the second plier member 34.

In addition, the assortment of laminations are interconnected by a plurality of rivets 66, in a manner as is generally known, in order to hold the laminated construction of the pliers 30 together. The assortment of laminations are preferably die-stamped or laser-cut from high grade, heat treated sheet steel or tool steel for load bearing laminations 54, 60, 62 and 56, and sheet steel or other materials for central layers 58. Of course, handle grips may be provided on the handle portions 36 and 42, but are not shown in the drawings. Laminations 58 and 64 in the jaw portions 40 and 46 can be formed by die-stamped or laser cut steel or alternative materials and processes such as forged or die cast metallic materials, tool steel, or injection molded resinous plastic materials, or other conventional materials previously used or usable on pliers.

Alternative construction techniques such as single-sided constructions typically found in scissors can be considered instead of the symmetrical laminations using a construction of inter-penetrating members. The entire members 32 and 34 can alternatively be forged or die-cast metal, or injection molded resinous plastic with or without metallic inserts. The described materials and processes can be used in various combinations for achieving different plier designs for different applications.

In accordance with an important aspect of the present invention, the pliers 30 further include first pivot means on the intermediate portions 38 and 44 permitting the jaw portions 40 and 46 to converge on a workpiece and grasp the workpiece in response to an initial movement of the handle portions 36 and 42 toward each other. The pliers 30 also include second pivot means on the intermediate portions 38 and 44 permitting a further grasping force to be applied to the workpiece in response to continued movement of the handle portions 36 and 42 toward each other. Advantageously, the second pivot means is positioned closer to the jaw portions 40 and 46 than the first pivot means so that a greater mechanical advantage may be obtained when using the pliers 30.

With particular reference to FIGS. 1, 4, and 7–9, the first and second pivot means will be explained in more detail. The first pivot means includes a pivot pin 68 attached to the intermediate portion 44 of the second plier member 34. The pin 68 may be attached to the intermediate portion 44, for example, by mechanical interference fit, by providing a grooved center section of pin 68 (not shown), by spring action if pin 68 is a rolled spring pin, or by welding or other means which are generally known in the art. The first pivot means further includes a positioning slot 70 formed in the intermediate portion 38 of the first plier member 32. It will be appreciated that the positioning slot 70 is formed on both sides of the pliers 30, i.e., formed both on the first and second outer laminations 54 and 56. The positioning slot 70 includes a generally arcuate portion 72 and a shifting slot portion 74 in communication with the generally arcuate portion 72. The pin 68 is slidably received in the positioning slot 70.

The second pivot means includes a pivot pin 76 attached to the intermediate portion 38 of the first plier member 32 and a generally arcuate main rack 78 on the intermediate portion 44 of the second plier member 34. The main rack 78 includes a plurality of notches 80 which cooperate with the pin 76 during operation of the pliers 30, as will be described in detail herein.

In accordance with an important aspect of the invention, the generally arcuate portion 72 of the positioning slot 70 has a curvature generally centered about the pin 76. In addition, the generally arcuate main rack 78 has a curvature generally centered about the pin 68. The relative movement of first and second plier members 32 and 34 against each other are therefore controlled by the precise geometry of defined pivot points in corresponding arcs. This approach allows tight tolerances and precise, predictable and repeatable adjustment in grasping action with minimal looseness and play in the pliers 30.

Referring to FIGS. 1, 4 and 7–9, the operation of the pliers 30 and the self-adjustment thereof to grasp a workpiece W will be described. Specifically, FIGS. 1 and 4 show the pliers 30 in a fully opened position with the handle portions 36 and 42 being at the fartherest most point away from each other and the jaw portions 40 and 46 being at the fartherest most point away from each other. The telescoping spring 48, secured between the handle portions 36 and 42, serves to maintain the pliers in the fully opened position. The pivot pin 68 is positioned in the shifting slot portion 74 of the positioning slot 70 while the pliers 30 are in the fully opened position (FIGS. 1 and 4). The pivot pin 68 is also positioned in the shifting slot portion 74 of the positioning slot 70 when the handle portions 36 and 42 are initially moved toward each other (as indicated by arrows A in FIG. 7) in response to the user squeezing the handle portions 36 and 42 and applying a force thereto to grasp the workpiece W. The telescoping spring 48 acts against the handle portion 36 of the first plier member 32 and causes the handle portion 36 to be lifted upward forcing the pivot pin 68 to remain in the shifting slot portion 74 of the positioning slot 70. In addition to the handle portions 36 and 42 initially moving toward each other to grasp the workpiece W, the jaw portions 40 and 46 also move toward each other (as indicated by arrows B in FIG. 7). During this movement of the handle portions 36 and 42 toward each other and the jaw portions 40 and 46 toward each other, the pivot pin 68 acts as the central pivot point of the pliers 30.

Figure 7:
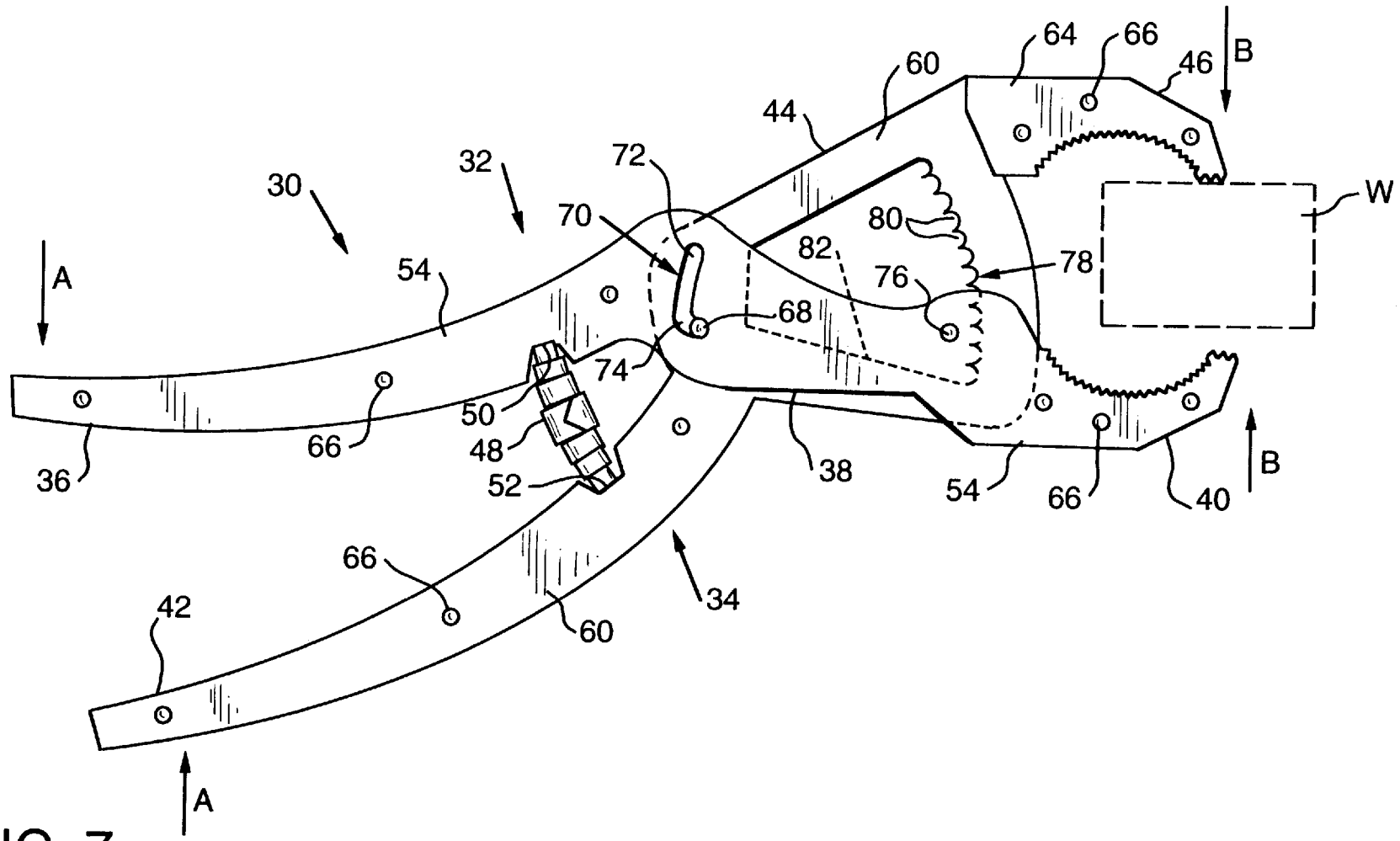
FIG. 7 is a further side elevational view of the pliers shown in FIG. 1 with the pliers being operated to grasp a workpiece.

While the pliers 30 are in the fully opened position, the telescoping spring 48 acting against the handle portion 36 of the first plier member 32 serves to maintain the pivot pin 76 against surface 82 of the intermediate portion 44 of the second plier member 34 (FIG. 4). As long as the pivot pin 68 remains positioned in the shifting slot portion 74 of the positioning slot 70, the pivot pin 76 remains spaced apart from and disengaged from the plurality of notches 80 of the main rack 78. As the handle portions 36 and 42 are moved toward each other, the jaw portions 40 and 46 also move toward each other resulting in the pivot pin 76 moving upward at a relatively spaced distance from the plurality of notches 80 (FIG. 7). During this movement, the pivot pin 68 remains positioned in the shifting slot portion 74 of the positioning slot 70 and the pivot pins 68 continues to act as the central pivot point of the pliers 30.

Figure 8:
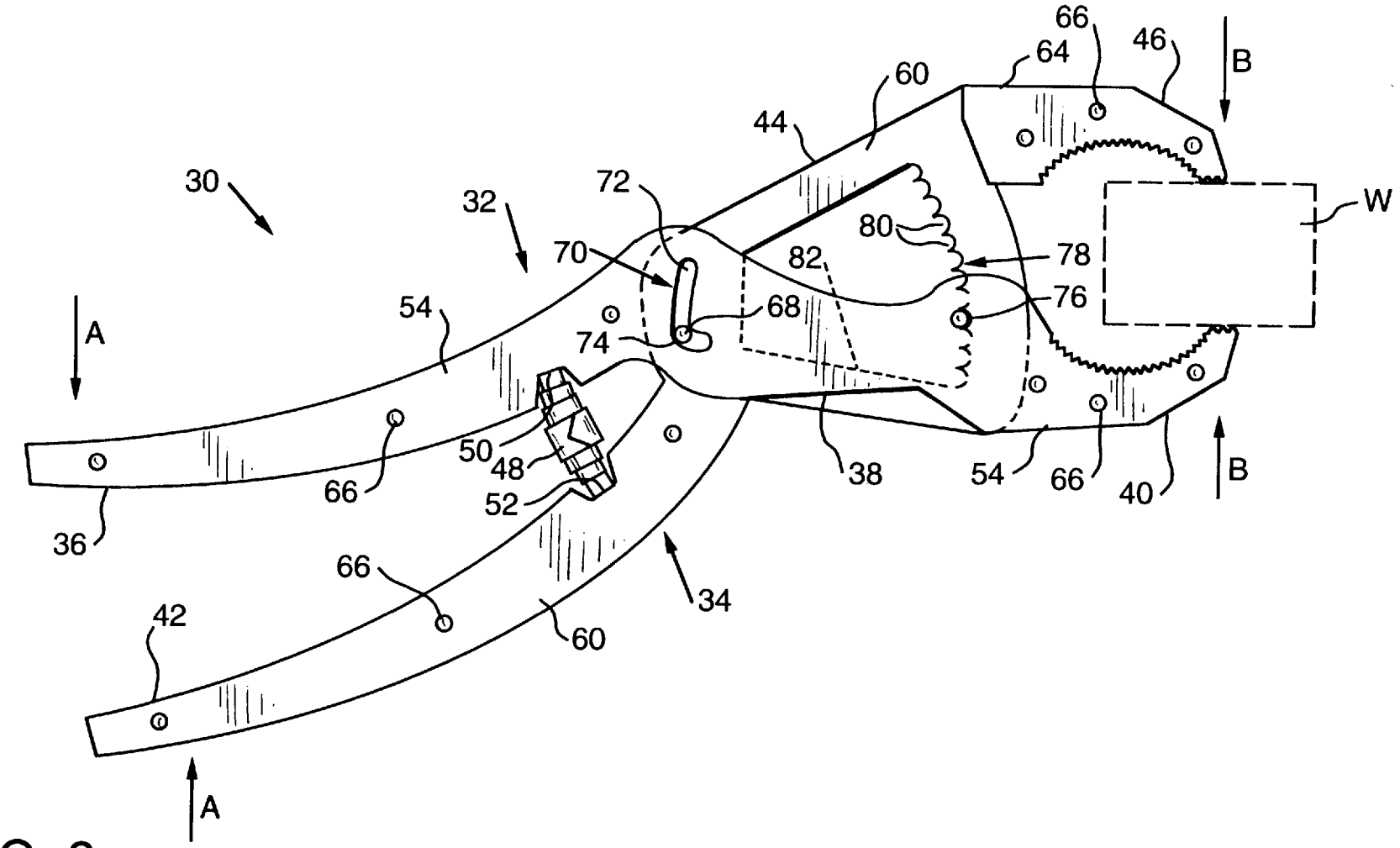
FIG. 8 is a further side elevational view of the pliers shown in FIG. 1 with the pliers fully grasping a workpiece.

Referring to FIG. 8, continued movement of the handle portions 36 and 42 toward each other in the direction of arrows A causes the jaw portions 40 and 46 to also continue toward each other in the direction indicated by arrows B until such time as the jaw portions 40 and 46 make initial contact with or grasp the workpiece W. Once the jaw portions 40 and 46 grasp the workpiece W, the pivot pin 68 begins to move from the shifting slot portion 74 of the positioning slot 70 into the generally arcuate portion 72 of the positioning slot 70. At the same time, movement of the pivot pin 68, as described, results in the pivot pin 76 moving into engagement with one of the notches 80 of the main rack 78. This causes the central pivot point of the pliers 30 to shift or be transferred from the pivot pin 68 to the pivot pin 76. Therefore, it will be appreciated that the continued movement of the handle portions 36 and 42 toward each other and the engagement between the jaw portions 40 and 46 with the workpiece W results in a termination of pivoting of the pliers about the pivot pin 68 and the initiation of pivoting of the pliers about the pivot pin 76. As will be further appreciated, the transfer or the shifting of the central pivot point to the pivot pin 76, which is located closer to the jaw portions 40 and 46, and the workpiece W being grasped thereby, results in a greater mechanical advantage being obtained during continued movement of the handle portions 36 and 42 toward each other, as will be described in more detail herein.

Figure 9:
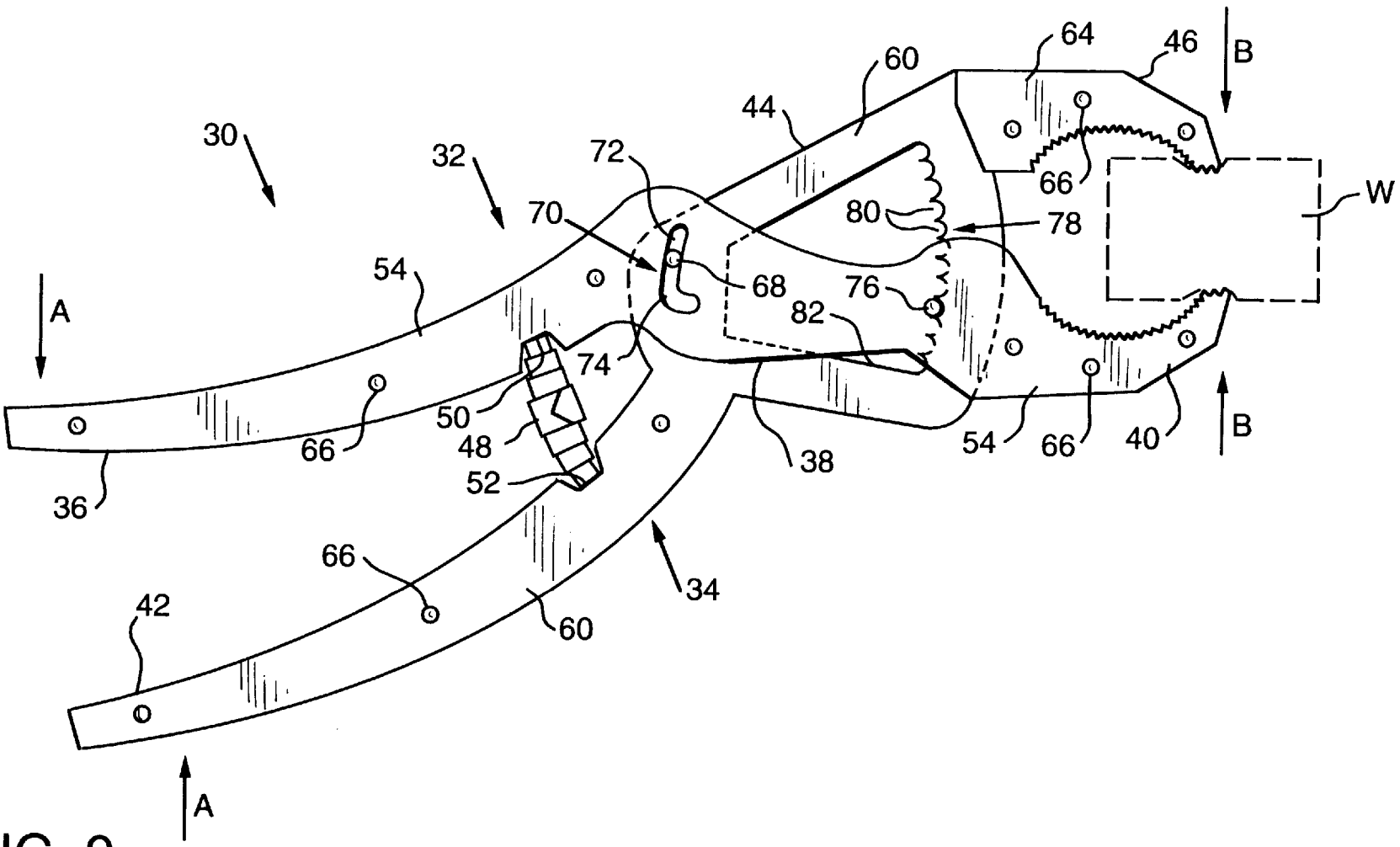
FIG. 9 is a further side elevational view of the pliers shown in FIG. 1 with the pliers applying a further grasping force to a workpiece.

Referring to FIG. 9, once the central pivot point has shifted from the pivot pin 68 to the pivot pin 76 that is in engagement with one of the notches 80 of the main rack 78, continued movement of the handle portions 36 and 42 toward each other will result in a further grasping force being applied to the workpiece W. The continued movement of the handle portions 36 and 42 toward each other result in the pivot pin 68 moving upward in the generally arcuate portion 72 of the positioning slot 70. This causes the jaw portions 40 and 46 to apply the further grasping force to the workpiece W.

Once the handle portions 36 and 42 are no longer being moved toward each other and pressure is released therefrom, the telescoping spring 48 causes the pliers to move to the fully opened position as shown in FIGS. 1 and 4. When pin 68 returns to its pivoting position in the shifting slot portion 74 of positioning slot 70, the pivot pin 76 becomes disengaged from the notch 80. The pliers are then ready for further operation as described herein.

The positioning slot 70 serves as an integral part of the present invention. For example, the positioning slot 70 allows the pliers to pivot about the pivot pin 68, as well as, maintains the pivot pin 76 in engagement with the plurality of notches 80 of the main rack 78 when the central pivot point switches to the pivot pin 76. In the preferred embodiment described herein, the positioning slot 70 has two distinct parts to its shape: the shifting slot portion 74 and the generally arcuate portion 72. The shifting slot portion is shaped in the form of a "dog-leg" in communication with the generally arcuate portion 72. The shifting slot portion 74 is used to force the first plier member 32 forward, and in particular to force the pivot pin 76 forward and into engagement with one of the plurality of notches 80 of the main rack 78, when initial force is applied to the workpiece W by the jaw portions 40 and 46. The generally arcuate portion 72 is designed to keep the pivot pin 76 engaged with the main rack 78 and stationary with respect thereto as more force is applied during continued movement of the handle portions 36 and 42 toward each other. Advantageously, the curvature of the main rack 78 is generally centered about the pivot pin 68 to create an identical geometric relationship between any of the notches 80 and the pivot pin 68 assuring that the self-adjustment mechanism will perform identically whether a small or a large object is being grasped. Hence, a highly precise adjustment mechanism can be achieved with simple manufacturing technology. In addition, the curvature of the generally arcuate portion 72 of the positioning slot 70 which is centered about the pivot pin 76 allows the central pivot pin 68 to escape freely when additional force is placed on the handle portions 36 and 42 during force-engagement with a workpiece W. The curvature is centered at pivot pin 76 which is the geometric center of rotation during the clamping cycle.

The radius defining the curvature of the positioning slot 70 and the radius defining the curvature of the rack 78 are dependent on the relative distance between these two elements and the desired size of the mechanism and resulting pliers.

Whereas particular embodiments of the present invention have been described herein for purposes of illustration, it will be evident to those skilled in the art that numerous variations of the details may be made without departing from the invention as defined in the appended claims.

Referring to FIGS. 10–13, there is shown another embodiment of the invention. Self-adjusting pliers 130 are similar to the self-adjusting pliers 30 only including a translating pawl 175 pivotally secured by a translating pawl pivot pin 176 to the intermediate portion 138 of the first plier member 132 rather than the lone pivot pin 76 as described in the preferred embodiment herein. The pliers 130 also include a generally arcuate translating rack 178 formed on the intermediate portion 144 of the second plier member 134. The rack 178 includes a plurality of teeth 179 and the pawl 175 also includes a plurality of teeth 177 formed on a side thereof adjacent the plurality of teeth 179 formed on the rack 178.

Figure 10:
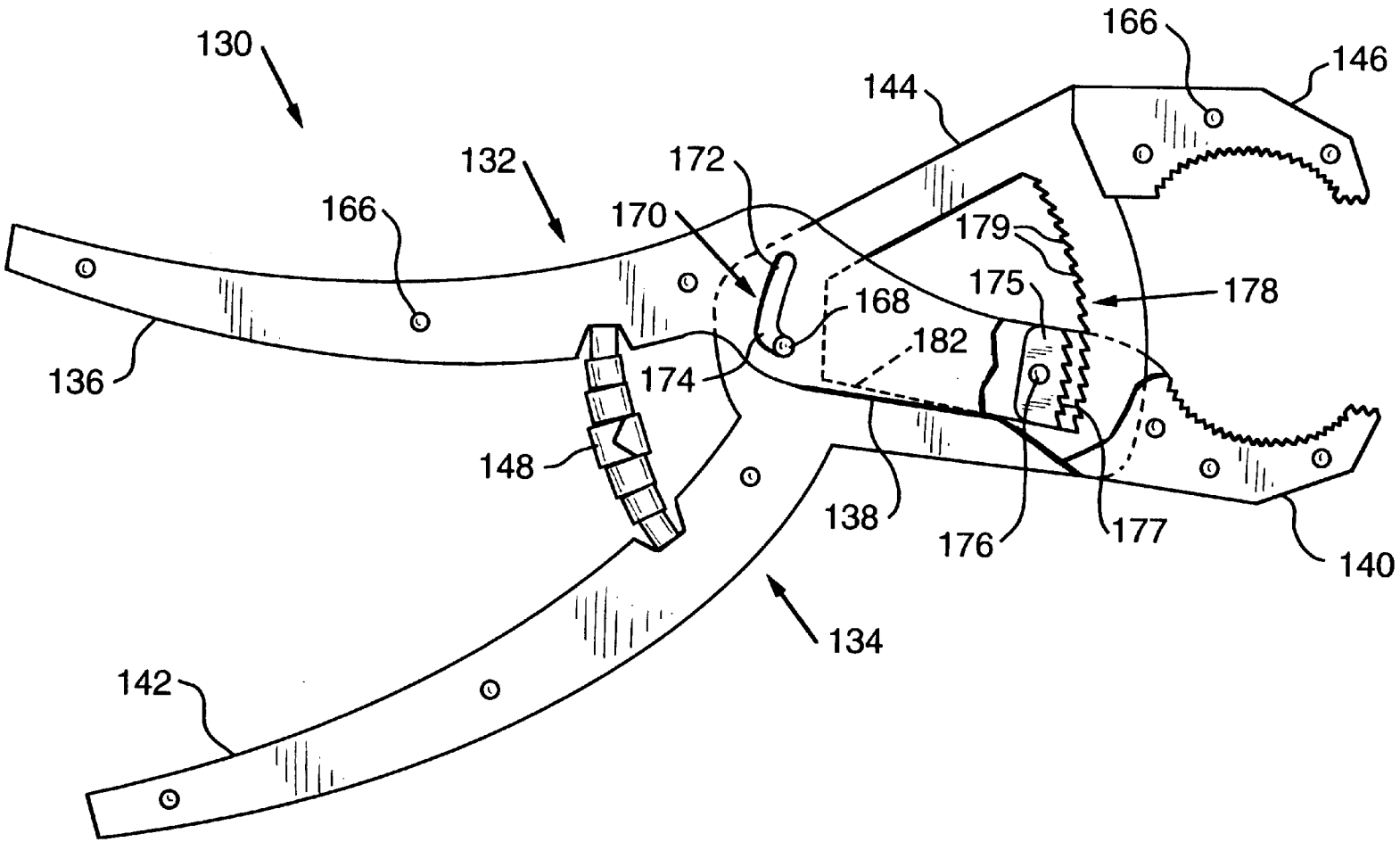
FIG. 10 is a side elevational view of a further embodiment of the present invention, showing the pliers in a fully open position.

FIG. 10 shows the pliers 130 in a fully open position. As in the preferred embodiment previously described, a telescoping spring 148 biases the handle portions 136 and 142 away from each other and the jaw portions 140 and 146 away from each other. While in the fully open position, the pivot pin 168 remains positioned in the shifting slot portion 174 of the positioning slot 170. In addition, the pawl 175 is maintained against a surface 182 of the intermediate portion 144 of the second plier member 134. The pawl 175, while the pliers 130 are in the fully open position, remains relatively spaced from the main rack 178.

Figure 11:
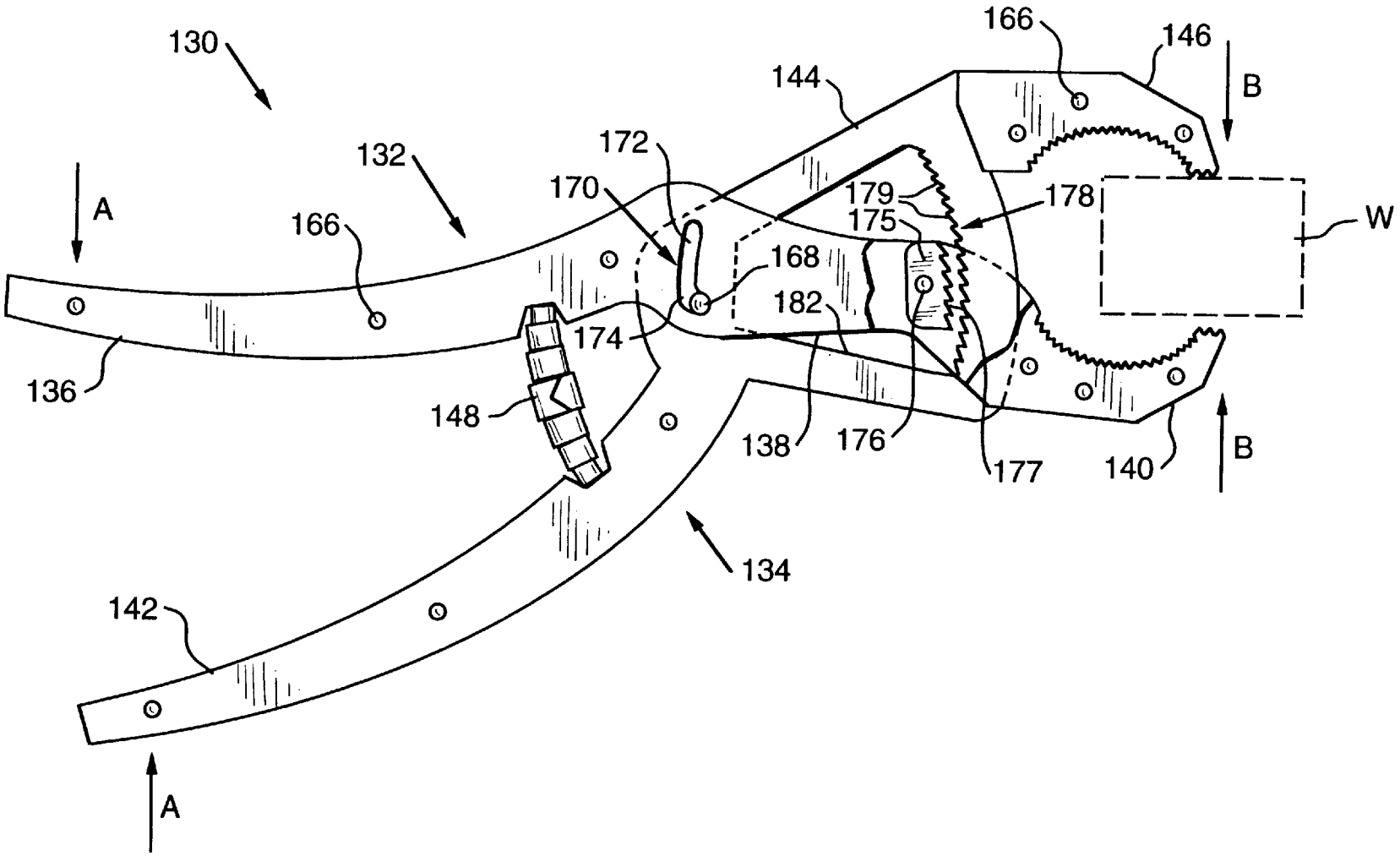
FIG. 11 is a further side elevational view of the pliers shown in FIG. 10 with the pliers being operated to grasp a workpiece.
Figure 12:
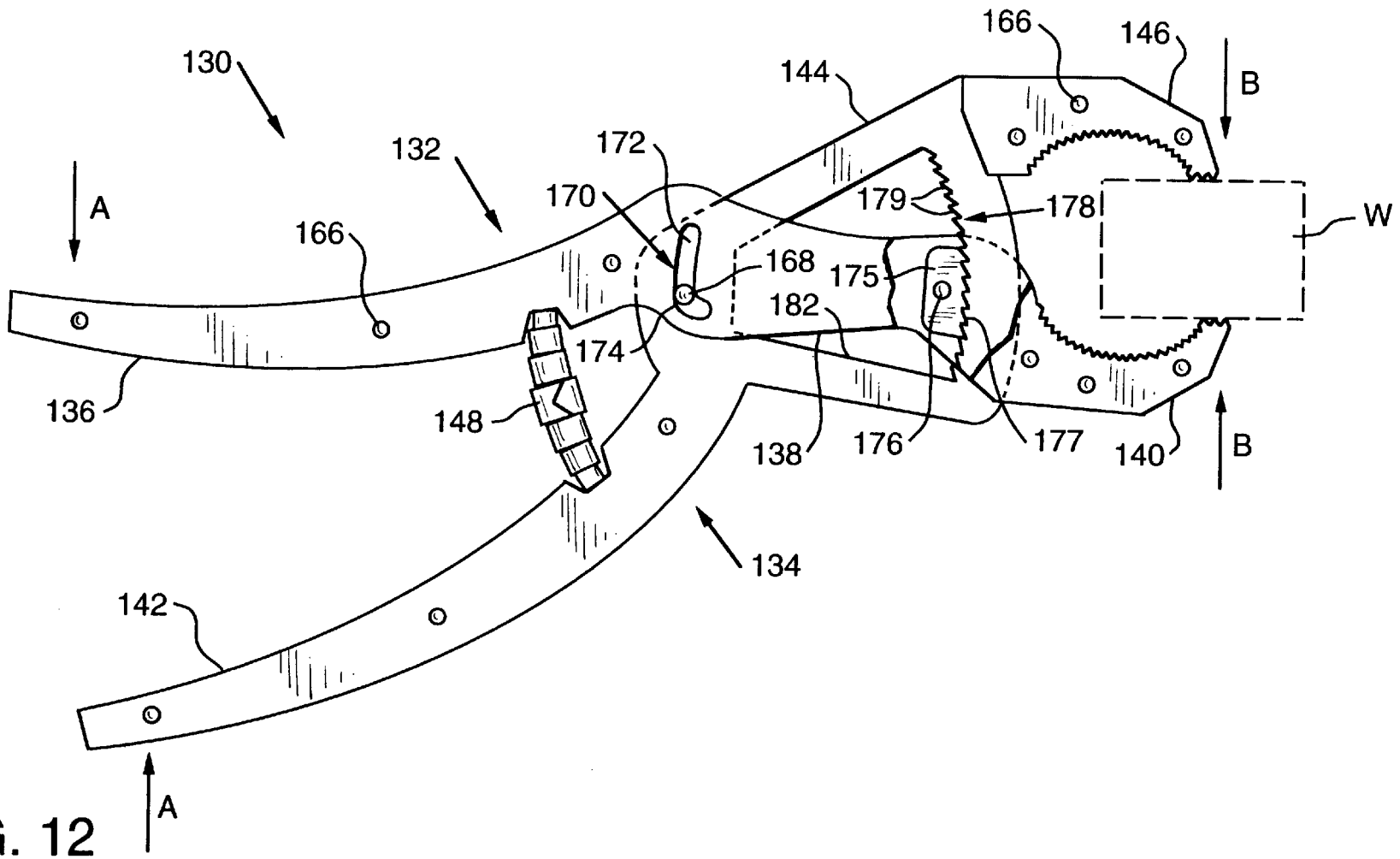
FIG. 12 is a further side elevational view of the pliers shown in FIG. 10 with the pliers shown grasping a workpiece.

As shown in FIG. 11, applying a force to the handle portions 136 and 142, causes the handle portions 136 and 142 to move toward each other as indicated by arrows A and jaw portions 140 and 146 to move toward each other as indicated by arrows B to grasp a workpiece W. This in turn results in the pawl 175 moving upward in relation to the main rack 178. Similar to the description provided herein for the preferred embodiment, once the jaw portions 140 and 146 engage the workpiece W, as shown in FIG. 12, the pivot pin 168 moves out of the shifting slot portion 174 and into the generally arcuate portion 172 forcing the plurality of teeth 177 on the pawl 175 into engagement with the plurality of teeth 179 formed on the main rack 178. This also results in a shifting of the central pivot point of the pliers 130 from the pivot pin 168 to the pivot pin 176 on which the pawl 175 is mounted.

Figure 13:
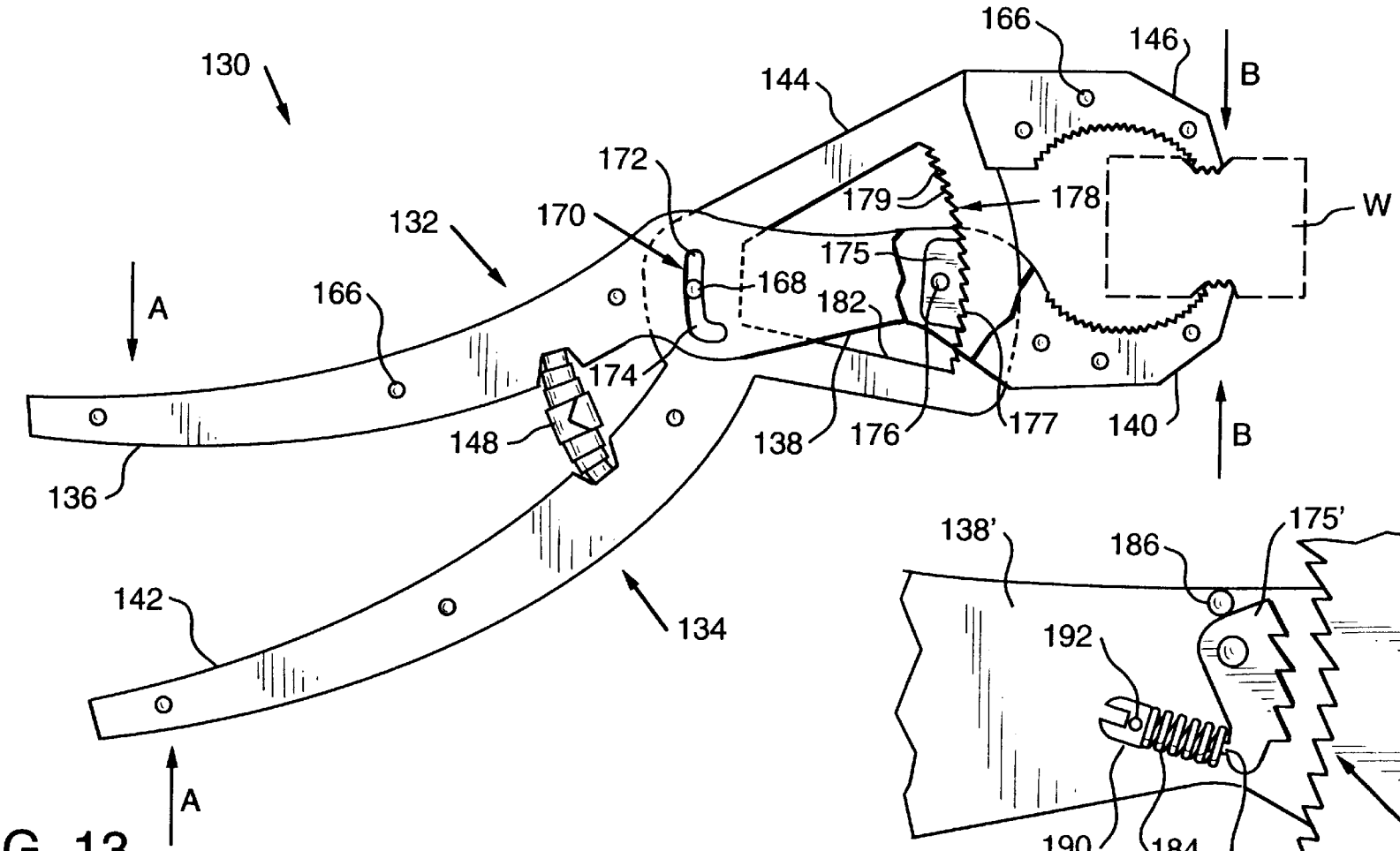
FIG. 13 is a further side elevational view of the pliers shown in FIG. 10 with the pliers shown as applying a further grasping force to a workpiece.

FIG. 13 illustrates continued movement of the handle portions 136 and 142 toward each other in order to apply a further grasping force to the workpiece W. This results in the pivot pin 168 continuing to move upward within the generally arcuate portion 172 of the positioning slot 170. Of course, by releasing the pressure on handle portions 136 and 142, the pliers 130 return to the fully open position as shown in FIG. 10.

In the embodiments set forth in FIGS. 10–13, the generally arcuate portion 172 of the positioning slot 170 has a curvature generally centered about the pivot pin 176 which pivotally secures the pawl 175 to the intermediate portion 138 of the first plier member 132. In addition, the rack 178 has a curvature generally centered about the pivot pin 168. Because the pivot pin 168 is positively guided in the positioning slot 170, all of the plurality of teeth 177 of the pawl 175 are simultaneously pressed into firm engagement with the corresponding teeth 179 of the rack 178. Because of such positive engagement control, the height and pitch of the teeth 177 and 179 can be minimized, resulting in much greater sensitivity and responsiveness of the self-adjusting mechanism without diminished strength or load carrying capacity. An additional benefit of reducing internal play within the mechanism by minimizing play and pitch of the teeth 179 of the rack 178 is that the widest, practical handle separation for comfortable one-handed operation of the pliers 130 permits a wide gripping range of the jaw portions 140 and 146 so that larger workpieces can be grasped.

Figure 14:
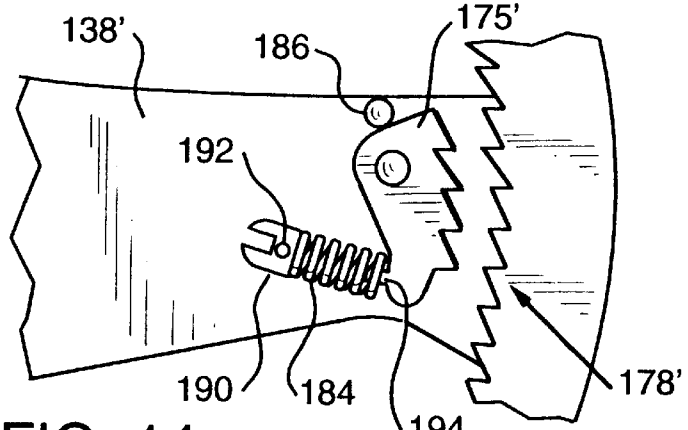
FIG. 14 is a partial, enlarged side view of yet another embodiment of the invention.

Referring to FIG. 14, there is shown a further embodiment of the invention. This embodiment is similar to the embodiment illustrated in FIGS. 10–13 and described herein, only employing a compression spring 184 acting in conjunction with a stop member 186 for urging the translating pawl 175' into a concentric relationship with the generally arcuate translating rack 178'. Preferably, the stop member 186 is formed on the intermediate portion 138' of the first plier member and positioned for contacting a side 188 of the pawl 175'. In addition, the compression spring may be attached to intermediate portion 138' by a fastening element 190 that is secured to the intermediate portion 138' by pin 192 or by, for example, a spring retention tab (not shown) formed out of the surface of the intermediate portion 138' and acting against compression spring 184 or by other similar means known in the art. The compression spring 184 is connected at the opposing end to the pawl 175' by tab 194. Advantageously, this arrangement maintains the pawl 175' in a concentric relationship with the rack 178' during movement of the pawl 175' with respect thereto.

Of course, other arrangements may be provided for maintaining the translating pawl 175 in a concentric relationship with the generally arcuate translating rack 178. For example, the intermediate portion 144 may be formed with a concentric slot, centered on pivot pin 168, with the pawl 175 having a rear surface shaped identical in curvature with the curve of the concentric slot. The width of the slot is then formed so that the teeth 177 of the pawl 175 are relatively spaced from the teeth 179 of the rack 178 when the pawl 175 is pressed against the rear surface of the concentric slot.

In either embodiment set forth in FIG. 14, or the embodiment not shown but described as having a concentric slot with a pawl received therein, the purpose of keeping the pawl parallel to the rack is to minimize the engagement distance and hence increase the responsiveness of the mechanism. Because the pawl is held parallel to the rack, the motion caused by pin 168 shifting in slot 170 simultaneously engages all pawl teeth with the rack teeth. This allows the profile and pitch of the teeth to be minimized to further increase the mechanism's responsiveness without sacrificing strength or load bearing capability of the engaging parts.

Referring to FIGS. 15–17*a*, there is a shown a further embodiment of the present invention. This embodiment is directed toward self-adjusting pliers 230. The overall structure of pliers 230 is similar to previously described pliers 30 and 130 in that pliers 230 include first and second plier members 232 and 234 with the first plier member 232 having a handle portion 236, an intermediate portion 238 and a jaw portion 240 and the second plier member 234 having a handle portion 242, an intermediate portion 244 and a jaw portion 246.

In accordance with an important aspect of this embodiment, there is provided a pivot pin 268 which is attached to the intermediate portion 244 of the second plier member 234 and a positioning slot 270 having a generally arcuate portion 272 only which is formed in the intermediate portion 238 of the first plier member 232. The pivot pin 268 is slidably received in the generally arcuate portion 272 of the positioning slot 270. It will be appreciated that in this embodiment, the positioning slot 270 does not include a shifting slot portion as described for pliers 30 and 130.

In accordance with another important aspect of the pliers 230, there is provided a rachet pawl 275 that is pivotally secured by a rachet pawl pivot pin 276 to the intermediate portion 238 of the first plier member 232. Pliers 230 also include a generally arcuate rachet rack 278 formed on the intermediate portion 244 of the second plier member 234 and having a plurality of teeth 279. The pawl 275 also includes a plurality of teeth 277 formed on a side thereof adjacent the teeth 279 of the rack 278. An important aspect of this embodiment is that the teeth 277 of the pawl 275 remain in engagement with the teeth 279 of the rack 278 while the pliers 230 are in the fully open position (FIG. 15), during the initial movement of the handle portions 236 and 242 toward each other to grasp the workpiece W (FIG. 16), and during the continued movement of the handle portions toward each other to apply a further grasping force to the workpiece W (FIG. 17). The pawl 275 is maintained in engagement with the rack 278 by a compression spring 284 which at one end is connected to the pawl 275 by a tab 294 and at the opposing end is attached to the intermediate portion 238 of the first plier member 232 by, for example, a fastening element 290 secured to the intermediate portion 238 by a pin 292.

Figure 15:
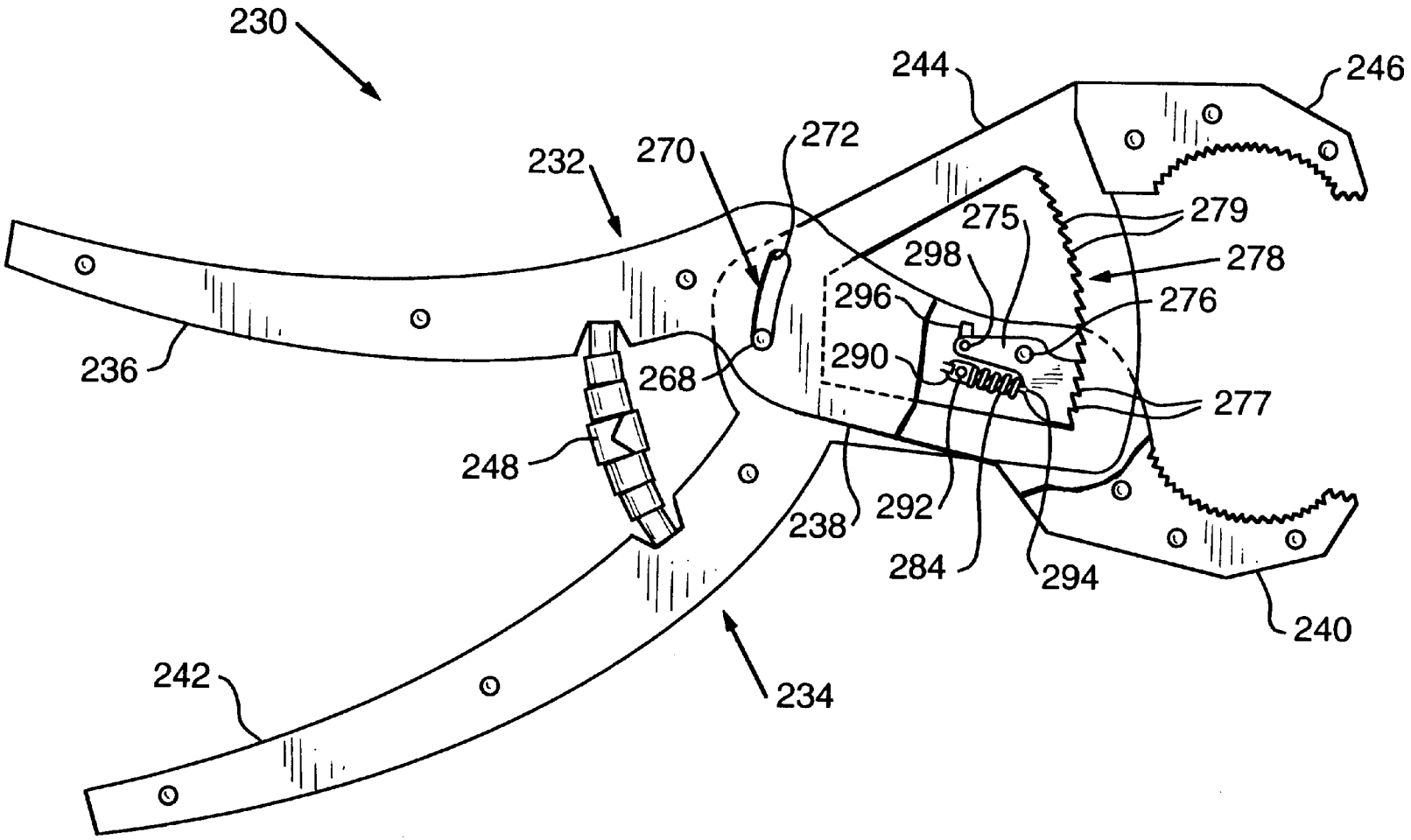
FIG. 15 is a side elevational view of another embodiment of the invention showing the pliers in a fully open position.

The operation of the pliers 230 will now be explained in more detail. As stated, FIG. 15 shows the pliers 230 in a fully open position. The telescoping spring 248, as in previous embodiments, is secured to the handle portions 236 and 242 and biases the handle portions 236 and 242 away from each other, as well as, biases the jaw portions 240 and 246 away from each other. The telescoping spring 248 also acts against the handle portion 236 to maintain the pivot pin 268 firmly seated in a lower portion of the generally arcuate slot 272 while in the fully open position.

Figure 16:
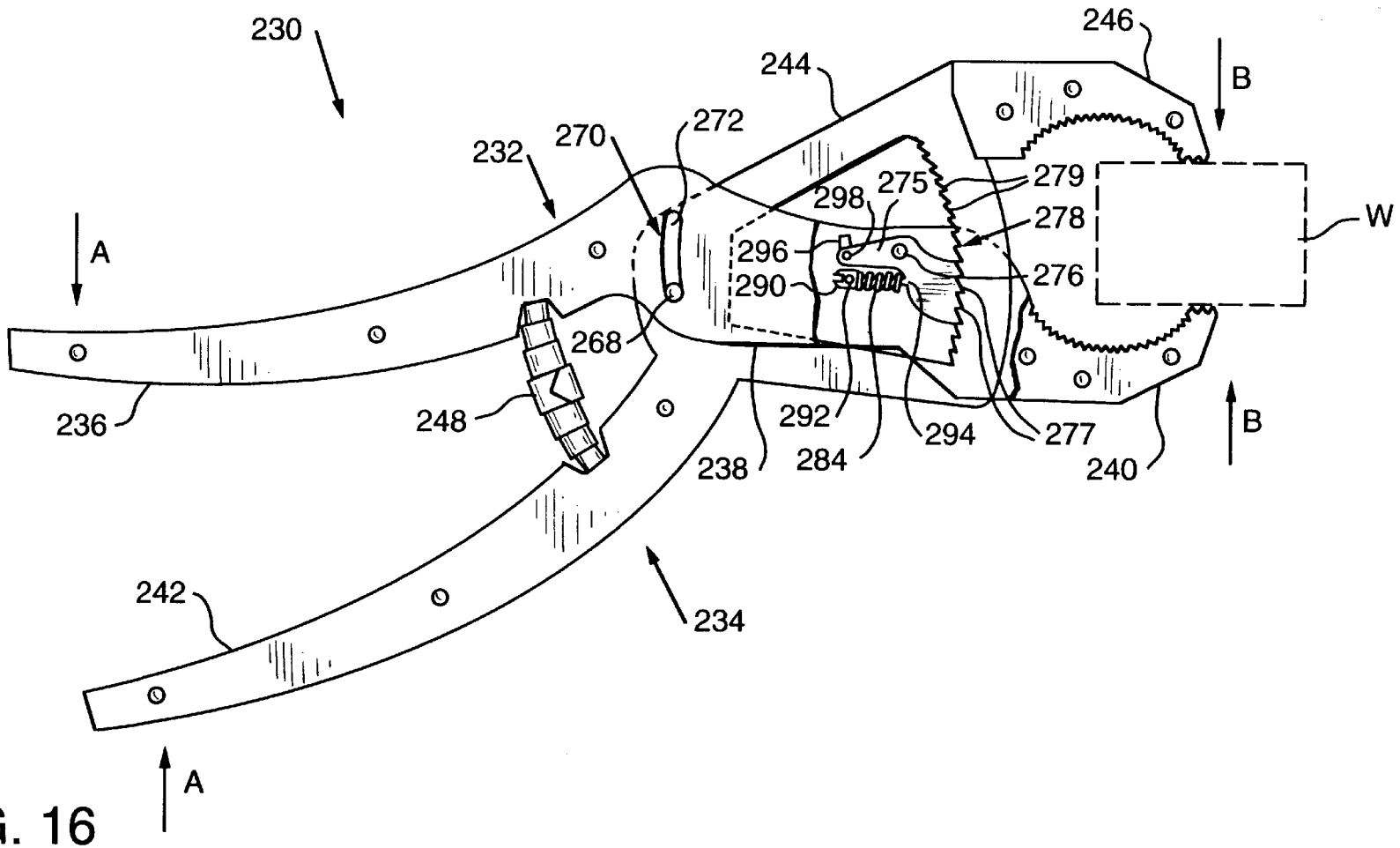
FIG. 16 is a further side elevational view of the pliers shown in FIG. 15 with the pliers grasping a workpiece.
Figures 17, 17A:
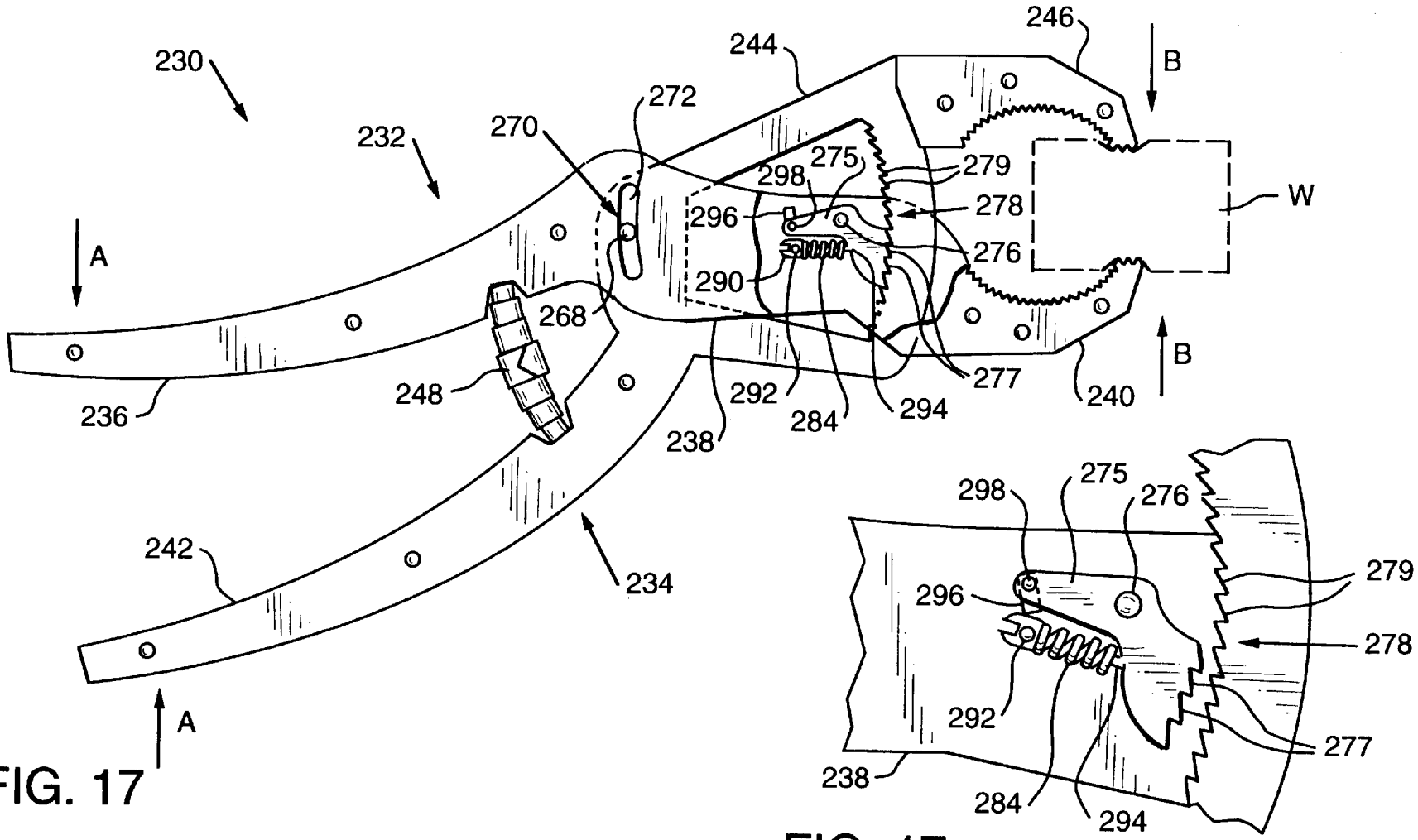
FIG. 17 is a further side elevational view of the pliers shown in FIG. 15 with the pliers shown as applying a further grasping force to a workpiece.
FIG. 17*a* is a partial, enlarged view illustrating a further aspect of the pliers shown in FIG. 15.

As shown in FIG. 16, applying a force or pressure to the handle portions 236 and 242 causes the handle portions to move toward each other as indicated by arrows A. This also results in the jaw portions 240 and 246 moving in the direction indicated by arrows B in order to self-adjust to the size of the workpiece W. During this initial movement of the handle portions 236 and 242 and the jaw portions 240 and 246, the pawl 275 ratchets up the rack 278 with the teeth 277 remaining in engagement with the teeth 279. In addition, the pivot pin 268 remains firmly seated in a lower portion of the slot 272 up and until such time as the jaws 240 and 246 contact the workpiece W. During the described movement to grasp the workpiece W, the pivot pin 268 acts as a central pivot point of the pliers 230.

Referring to FIG. 17, applying further pressure to handle portions 236 and 242, in order to move the handle portions in the directions indicated by arrows A, results in a further grasping force being applied to the workpiece W as a result of the jaw portions 240 and 246 also continuing to move toward each other in the direction indicated by arrows B. However, continued movement of the handle portions 236 and 242 toward each other once the jaw portions 240 and 246 have initially engaged the workpiece W (as shown in FIG. 16) results in the central pivot point of the pliers 230 shifting or transferring from the pivot pin 268 to the pin 276. Once the central pivot point has shifted to the pin 276, continued movement of the handle portions 236 and 242 in the direction indicated by arrows A causes the pivot pin 268 to move upward in the generally arcuate portion 272 of positioning slot 270.

As in previously described embodiments, the rack 278 has a curvature generally centered about the pivot pin 268, while the generally arcuate portion 272 of the positioning slot 270 has a curvature generally centered about the pin 276 which mounts the pawl member 275 to the intermediate portion 238.

With reference to FIG. 17*a*, the disengagement means for disengaging the teeth 277 of the pawl 275 from the teeth 279 of the rack 278 will be described. A release slot 296 is formed on the intermediate portion 238 of the first plier member 232 and a pin 298 extends through the pawl 275 and through the release slot 296. As shown in FIGS. 15–17, the release pin 298 remains in a lower portion of the release slot 296 while the pawl 275 is in engagement with the rack 278. As shown in FIG. 17*a*, by manually grasping the release pin 298 and moving it toward an upper portion of the release slot 296, the pawl 275 rotates in a clockwise direction about the pin 276. This causes the teeth 277 of the pawl 275 to become disengaged from the teeth 279 of the rack 278. Once this disengagement takes place, the telescoping spring 248 forces the handle portions 236 and 242 and the jaw portions 240 and 246 to move to the fully open position (FIG. 15) while the pawl 275 moves downward with respect to the rack 278 to its initial position. Once the release pin is no longer being held in the upper portion of the release slot 296, the pawl 275 rotates in a counterclockwise direction about the pin 276 and returns to engagement with the rack 278 (FIG. 15). Because the pawl 275 stays in engagement with the rack 278, the recoil or back lash in the system or pliers 230 can be minimized in order to maximize the responsiveness of the pliers 230 when engaging a workpiece. Greater responsiveness allows greater jaw opening range for a given handle separation, therefore increasing the adjustment range of the hand tool suitable for one-handed operation.

In accordance with another aspect of the invention, the self-adjusting pliers described herein may also include self-locking means for automatically locking the jaw portions into engagement with a workpiece. The self-locking aspect of the invention may be incorporated into the self-adjusting pliers, as described herein, or may be fitted on a pair of pliers without the self-adjusting aspects being included therewith.

With reference to FIGS. 18–22, there is illustrated self-adjusting and self-locking pliers 330 capable of both grasping a workpiece and locking the jaw portions into engagement with the workpiece. Similar to the self-adjusting pliers described herein, the pliers 330 also include a first plier member 332 and a second plier member 334 interconnected in a scissor-like arrangement for providing the self-adjusting and self-locking functions. The first plier member 332 includes a handle portion 336, an intermediate portion 338 and a jaw portion 340. Similarly, the second plier member 334 includes a handle portion 342, an intermediate portion 344 and a jaw portion 346.

Figure 18:
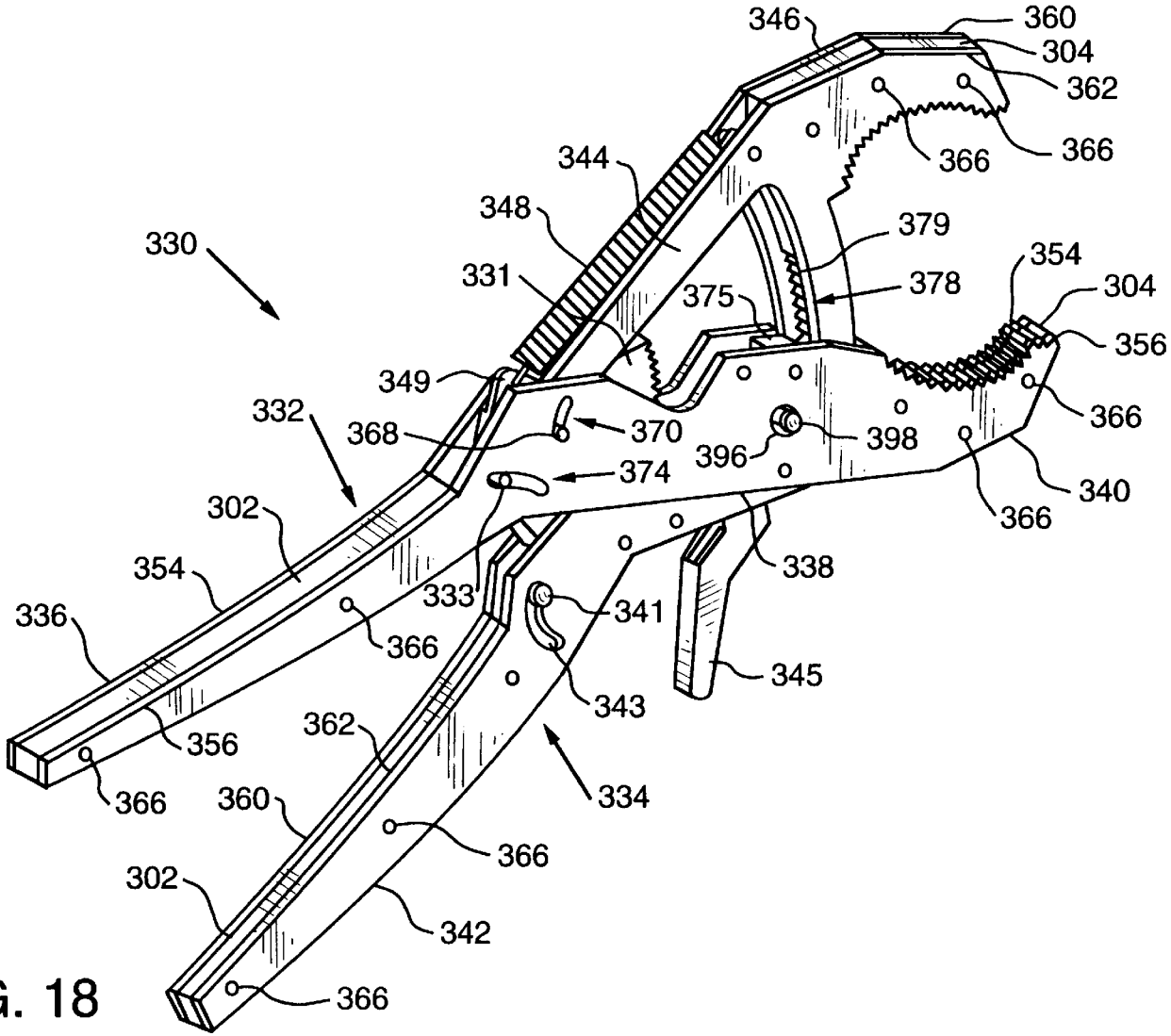
FIG. 18 is a perspective view of yet another embodiment of the invention illustrating hand held utility pliers having both self-adjusting and self-locking capabilities.
Figure 19:
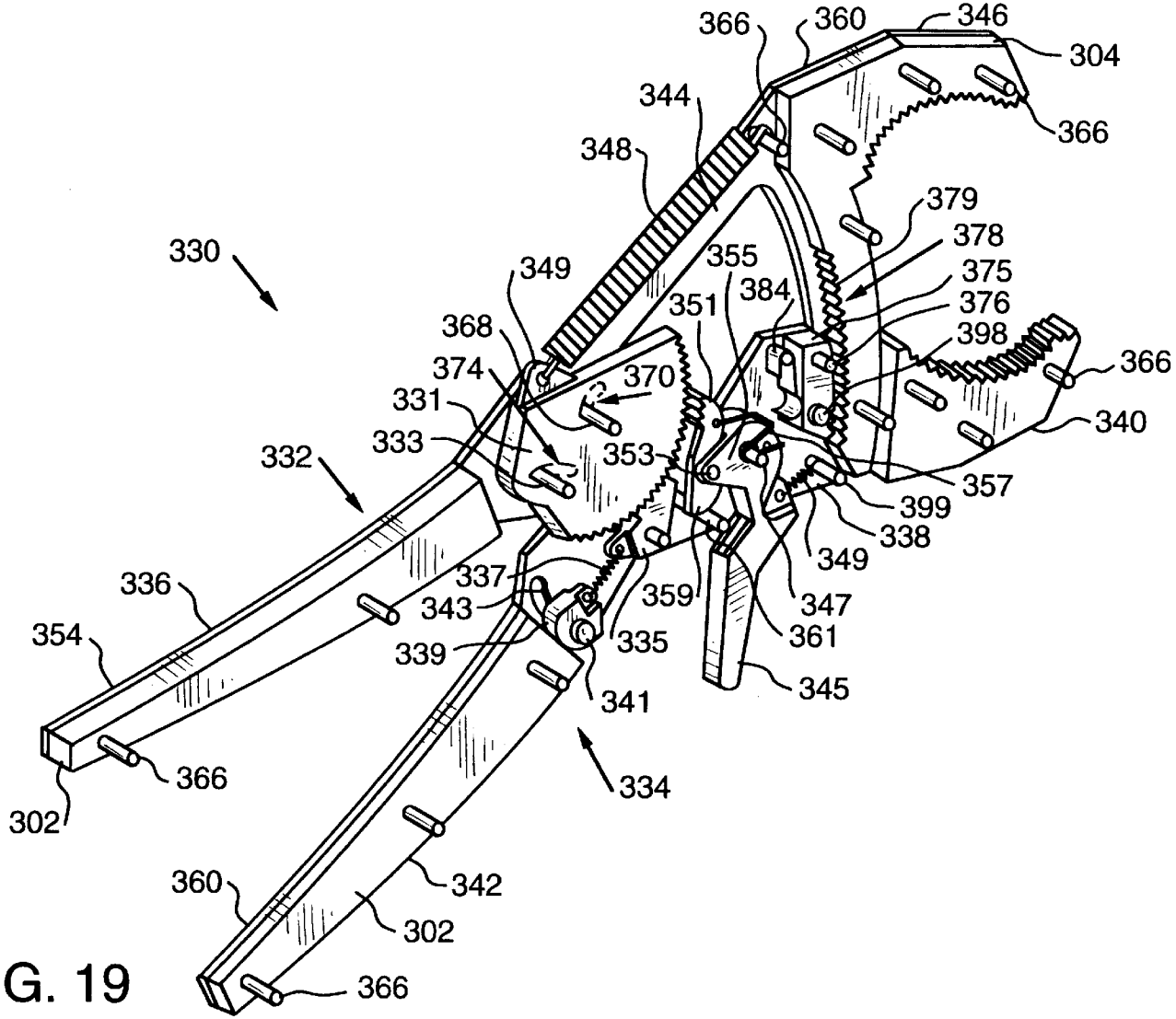
FIG. 19 is a perspective view, similar to FIG. 18, with certain components removed for clarity illustrating the self-adjusting and self-locking pliers.

Referring specifically to FIGS. 18 and 19, the pliers 330 are preferably formed of laminated construction in a manner similar to the construction of the self-adjusting pliers previously described herein. As shown, the first plier member 332 includes relatively spaced apart first and second outer laminations 354 and 356 which form the handle portion 336, the intermediate portion 338 and the jaw portion 340. Similarly, the second plier member 334 includes first and second inner laminations 360 and 362 that form the handle portion 342, the intermediate portion 344 and the jaw portion 346. A suitable filler material 302 may be provided between the laminations 354 and 356 of the handle portion 336, as well as, between the laminations 360 and 362 of the handle portion 342. The filler material 302 may be, for example, any suitable forged or die-cast metal or injection molded plastic to complete formation of the handle portions 336 and 342. In addition, a plurality of rivets 366 are provided for interconnecting the laminations 354 and 356 with the filler material 302 therebetween, as well as, for interconnecting the laminations 360 and 362 with the filler material 302 therebetween. Similarly, a filler material 304 may be provided between the laminations 354 and 356 which form the jaw portion 340 and between the laminations 360 and 362 which form the jaw portion 346. Rivets 366 are also provided for interconnecting the laminations and filler material in the jaw portions 340 and 346. The filler material 304 is preferably composed of a forged or die-cast metal so as to strengthen the jaw portions 340 and 346 for grasping a workpiece.

With particular reference to FIG. 19, the structure of the pliers 330 will be described in more detail. The pliers 330 include a cam rack 331, having a plurality of teeth, attached to the intermediate portion 344 of the second plier member 334 by a pivot pin 368 which extends through the cam rack 331. A cam pin 333 is permanently attached to the cam rack 331. The pivot pin 368 and cam pin 333 are slidably received in a positioning slot 370 and a cam slot 374, respectively, which are formed in the intermediate portion 338 of the first plier member 332 (see FIG. 18 where it will be appreciated that a positioning slot 370 and a cam slot 374 are formed on both sides of the pliers 330, but only one side is shown in FIG. 18). A tension spring 348, attached on one end to a lug 349 formed on the cam rack 331 and on another end to a rivet 366 formed on the intermediate portion 344 of the second plier member 334, biases the lug 349 toward the jaw portion 346. The bias provided by the spring 348 causes the cam rack 331 to rotate on pin 368 and also causes the cam pin 333 to impinge on the wall of the cam slot 374 which rotates the handle portion 336 around the pivot pin 368 and causes the handle portions 336 and 342 to move toward the fully open position (FIGS. 18 and 19). The spring 348 also biases the handle portion 336 upward forcing the pivot pin 368 against the bottom end of the positioning slot 370.

A lock pawl 335, having a plurality of teeth for engaging the plurality of teeth formed on the cam rack 331, is pivotally connected to the intermediate portion 344 of the second plier member 334 and is connected by a spring 337 to a switch 339 having a pin 341 that is slidably received in a lock slot 343. When the switch 339 is in the lower portion of the lock slot 343 or locked position (FIG. 19), it causes the lock pawl 335 to be biased into engagement with the cam rack 331. When the switch 339 is in the upper position or upper portion of the lock slot 343 or unlocked position (FIG. 22), it causes the lock pawl 335 to be biased toward disengagement from the cam rack 331. Of course, when in the unlocked position the pliers are free to act as self-adjusting pliers only and not self-locking.

A pump lever 345 is positioned between the outer laminations of intermediate portion 344 of the second plier member 334 and is pinned thereto by a pin 347. A spring 349 is connected on one end to a pin 399 formed on the intermediate portion 344 and on the other end to the pump lever 345. The spring 349 biases the pump lever 345 toward an open or unactuated position as shown in FIG. 19. A pump pawl 351, having a plurality of teeth for engaging the plurality of teeth of the cam rack 331, is pivotally connected by pin 353 to the upper end 355 of the pump lever 345. A torsion spring 357 is mounted on pin 347 and engages the pump lever 345 and the pump pawl 351 and biases the pump pawl 351 toward the cam rack 331. A bottom end 359 of the pump pawl 351 rests against release pin 361 when the pump lever 345 is in the open position (FIGS. 19 and 20) thereby resisting the bias of the torsion spring 357 and maintaining the pump pawl 351 out of engagement with the cam rack 331. As will be explained in more detail herein, actuation of the pump lever 345 will result in engagement between the pump pawl 351 and the cam rack 331.

The pliers 330 also include a rachet pawl 375 having a plurality of teeth 377 for cooperating with rachet rack 378 having a plurality of teeth 379. Similar to the embodiment set forth in FIG. 17*a* previously described herein, the rachet pawl 375 is mounted to the intermediate portion 338 by a pin 376. A leaf spring 384 also mounted on the intermediate portion 338 biases the rachet pawl 375 into engagement with the main rack 378. A release pin 398 is connected to the rachet pawl 375 and extends through a release slot 396 (FIG. 18) for disengaging the rachet pawl 375 from the rack 378.

Figure 20:
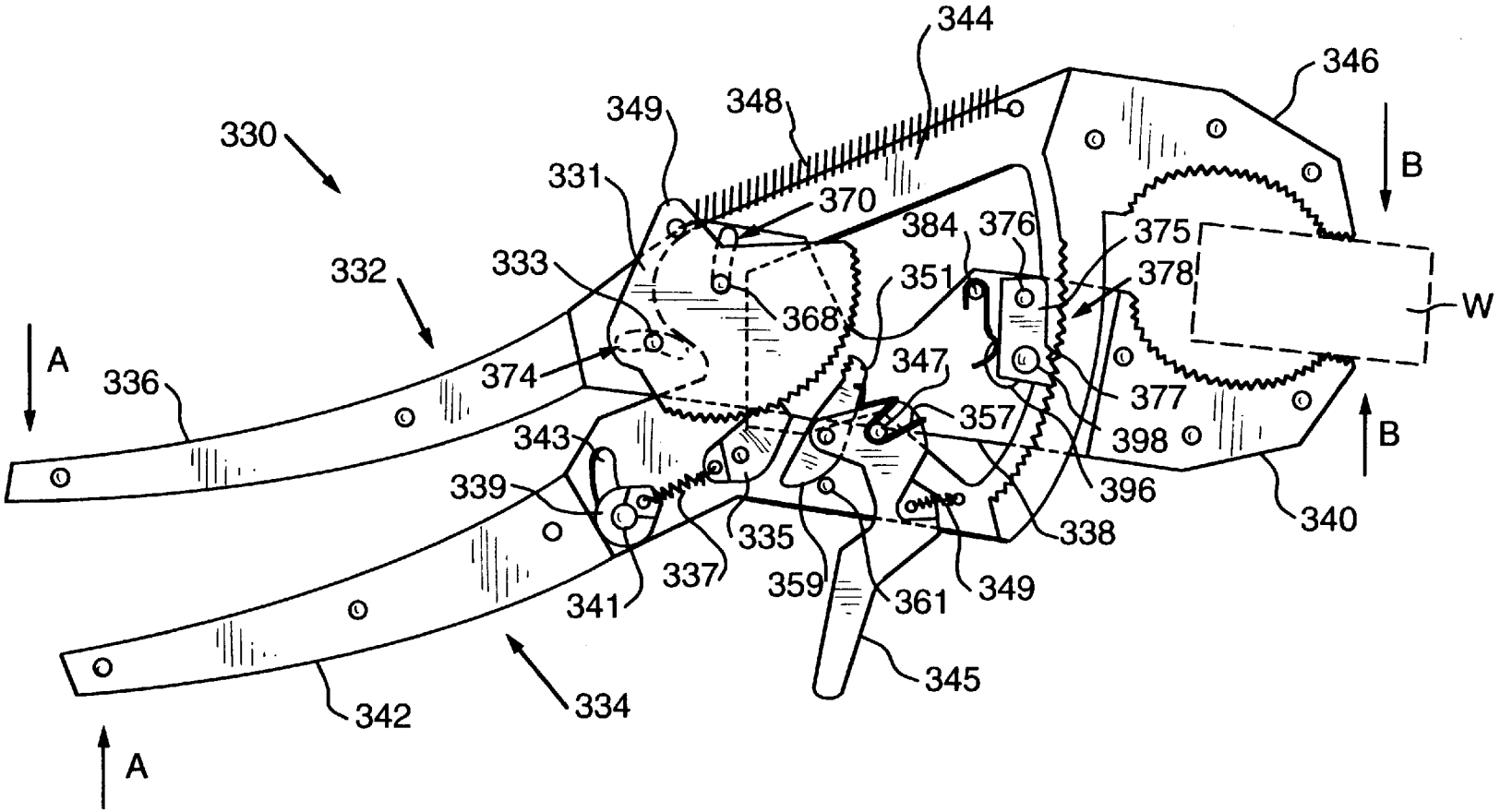
FIG. 20 is a side elevational view of the pliers shown in FIGS. 18 and 19.

Still referring to FIGS. 18–22, the operation of the pliers 330 will be described in detail. It will be appreciated that FIGS. 19–22 have certain parts, such as, for example, lamination 356 of the first plier member 332 and the lamination 362 of the second plier member 334, removed for clarity and for better describing the invention. It will also be appreciated that the side of the pliers 330 not shown in FIGS. 18–22 is essentially identical to the side being shown in these Figures. As the user applies a force to the handle portions 336 and 342, the handle portions move in the direction indicated by arrows A and at the same time the jaw portions 340 and 346 move in the direction indicated by arrows B to grasp the workpiece W (FIG. 20). During this movement, the handle portion 336, the jaw portion 340 and the cam rack 331 rotate about the pivot pin 368. As the jaw portions 340 and 346 begin to close down on the workpiece W, the spring 348 acts on the cam rack 331 with enough force to keep the first plier member 332 pulled up against the pivot pin 368 to oppose the downward force being applied by the user to the handle portions 336 and 342. This rotation of the first plier member 332 about the pivot pin 368 causes two synchronized movements. First, the cam rack 331, which is being held in a fixed relationship to the first plier member 332 by the force of the spring 348 acting through the cam pin 333, revolves around the pivot pin 368. It rotates in relation to the handle portion 342 and the jaw portion 346 of the second plier member 334 causing the cam rack 331 to rotate past the lock pawl 335 at the same rate as the handle portions 336 and 342 are converging. Second, the rachet pawl 375 ratchets up the rack 378 until the jaw portions 340 and 346 contact the workpiece W. This results in the central pivot point of the pliers being shifted or transferred from the pivot pin 368 to the pin 376 that pivotally secures the rachet pawl 375 to the intermediate portion 338, as previously described. While this transfer of the pivot points is taking place, the continued movement of the handle portions 336 and 342 in the direction indicated by arrows A, the spring 348 continues to be extended providing counter pressure against the user's hand that is applying the force to the handle portions 336 and 342. This causes the cam pin 333 to be forced along the cam slot 374 initiating rotation of the cam rack 331 in relation to the intermediate portion 338 of the first plier member 332. At this point, the cam rack 331 moves in relation to the lock pawl 335 at an accelerated rate compared to the rate at which the handle portions 336 and 342 are converging toward one another. In addition, the pivot pin 368 begins to move upward inside the positioning slot 370.

The described accelerated rotation of the cam rack 331 is a function of the following: the relative distances between the pin 376, the pivot pin 368 and the cam pin 333; the positions of the pin 376, the pivot pin 368 and the cam pin 333; as well as the contour and position of the cam slot 374. By varying these relationships, particularly by varying the angle, contour and position of the slot 374, a desired "force profile" can be determined for a set of pliers. For example, for clamping resilient workpieces, it may be desirable to provide large jaw movement with little force augmentation initially, then ramping up to increased force augmentation at the end of the clamping cycle. For rigid materials, it may be more desirable to provide only slight jaw movement combined with maximum force augmentation from the beginning of the clamping cycle. Therefore, it will be appreciated that the cam slot 374 may have a generally straight orientation or a generally arcuate orientation depending upon the force profile that is desired.

As the user of the pliers 330 continues to squeeze the handle portions 336 and 342 in the direction indicated by arrows A while clamping onto a workpiece W, the slack in the pliers 330 is taken up, the workpiece is compressed, and the pliers 330 flex. Resilience in the mechanical structure of the pliers 330 (as well as the resilience in the workpiece W) assures that the hand force applied to the workpiece W is stored in the pliers 330 while applying continued pressure on the clamped workpiece W. This pressure can be profiled by adjusting the degree of resilience in the pliers 330, and it is controlled by how much force is being applied to the handle portions 336 and 342 initially.

With particular reference to FIG. 20, the jaw portions 340 and 346 are shown in engagement with the workpiece W while the lock pawl 335 is in engagement with the cam rack 331 as a result of the switch 339 being in the locked position. At this point in the operation of the pliers 330, if the user's grip is released and no further pressure is being applied to the handle portions 336 and 342, the spring 348 and the pressure due to the energy stored in the resilient mechanical structure previously described causes the cam rack 331 to minimally rotate in a clockwise direction until this rotation is arrested by the lock pawl 335 which is biased against the cam rack 331 by the switch 339. At this point, both the rachet pawl 375 and the lock pawl 335 are engaged, balancing the load against the compressed workpiece W so that the pliers 330 will remain clamped to the workpiece W.

Figure 21:
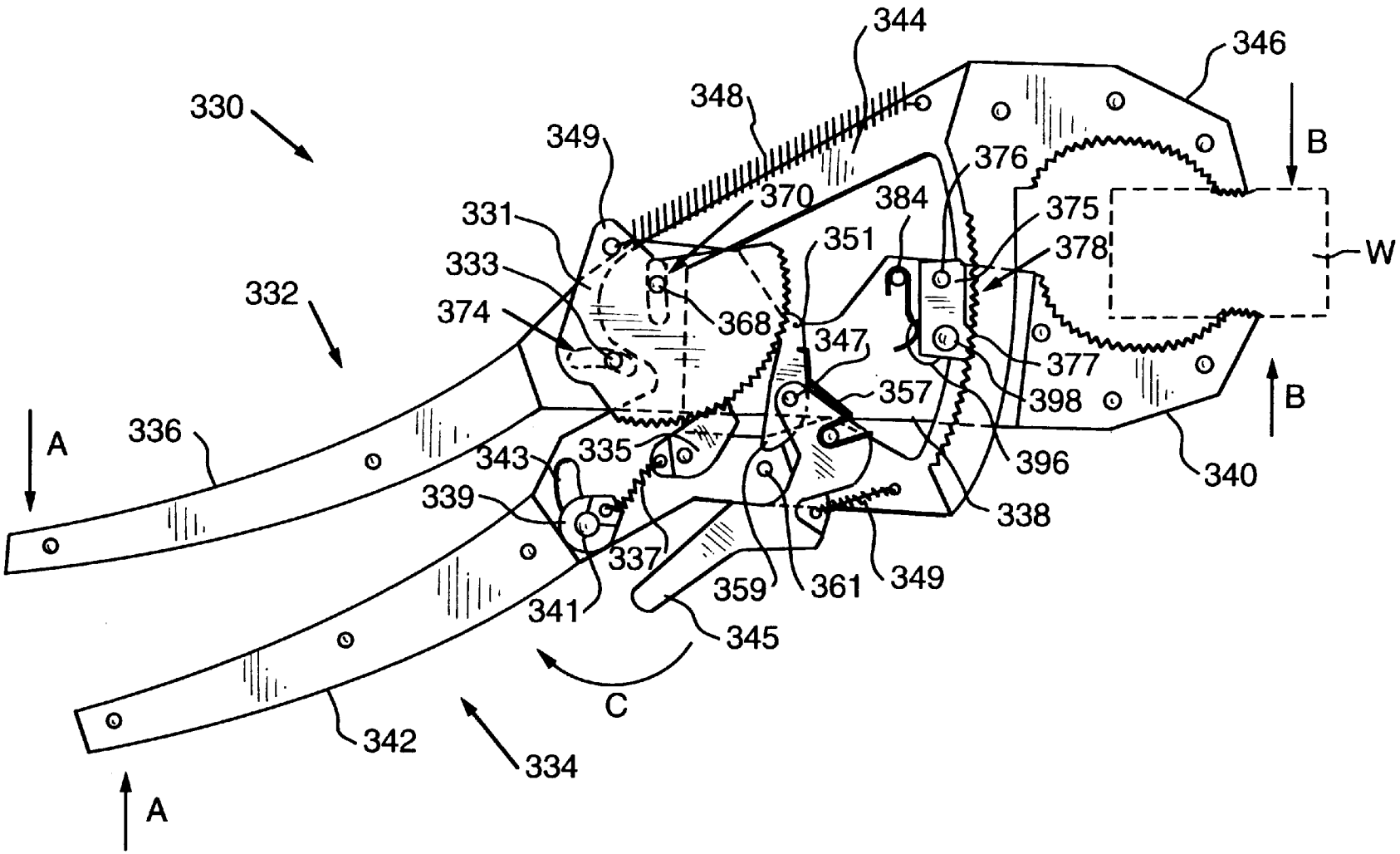
FIG. 21 is a further side elevational view of the pliers shown in FIGS. 18 and 19 illustrating an additional clamping force being applied to a workpiece.

Referring to FIG. 21, further operation of the pliers 330 to apply additional clamping force to the workpiece W will be described. The pliers 330 are designed for one-handed operation. At this stage, the user's hand that was applying the force or pressure to the handle portions 336 and 342 may be relaxed so that, for example, the index finger of the same hand can reach the pump lever 345. Repeated, trigger-like squeezing of the pump lever, i.e., rotation of the pump lever 345 in a clockwise direction (as indicated by arrow C), results in the application of the additional clamping force to the workpiece W as finger pressure is amplified by mechanical advantage. More specifically, triggering the spring-biased pump lever 345 first swings the pump pawl 351 into engagement with the cam rack 331 thereby applying a rotational force to the cam rack 331 and forcing the handle portion 336 of the first plier member 332 downward due to movement of the cam pin 333 in the cam slot 374. With the pin 376 acting as the central pivot point and fulcrum of the pliers 330, as described herein, additional clamping force is applied to the workpiece W. If finger pressure on the pump lever 345 and the pump pawl 351 is relaxed, the cam rack 331 rotation reverses minimally until blocked by the lock pawl 335. At this point, the pump pawl 351 retracts in relation to the cam rack 331. Repeated trigger action will incrementally rotate the cam rack 331 until the desired compression on the workpiece W has been achieved, or until the user's ability to compress the pump lever 345 has been exhausted. At this stage, maximum clamping force has been achieved and the pliers can stay clamped or automatically locked to the workpiece W indefinitely.

In accordance with an important aspect of this operation that results in the additional clamping force being applied to the workpiece W, the pump pawl 351 is biased toward engagement with the cam rack 331 by the torsion spring 357, as previously described. However, as also previously described, the release pin 361 contacts a bottom end 359 of the pump pawl 351 when the pump lever 345 is in the unactuated position shown in FIG. 19. As the pump lever 345 is actuated in a clockwise direction, the pump pawl 351 is lifted away from the release pin 361 thereby allowing the torsion spring 357 to bias the pump pawl 351 into engagement with the cam rack, as shown in FIG. 21. Once the pump lever 345 returns to the unactuated position (FIG. 20), the bottom end 359 due to its curved shape, once again comes to rest against the release pin 361 with the pump pawl 351 being disengaged from the cam rack 331.

Figure 22:
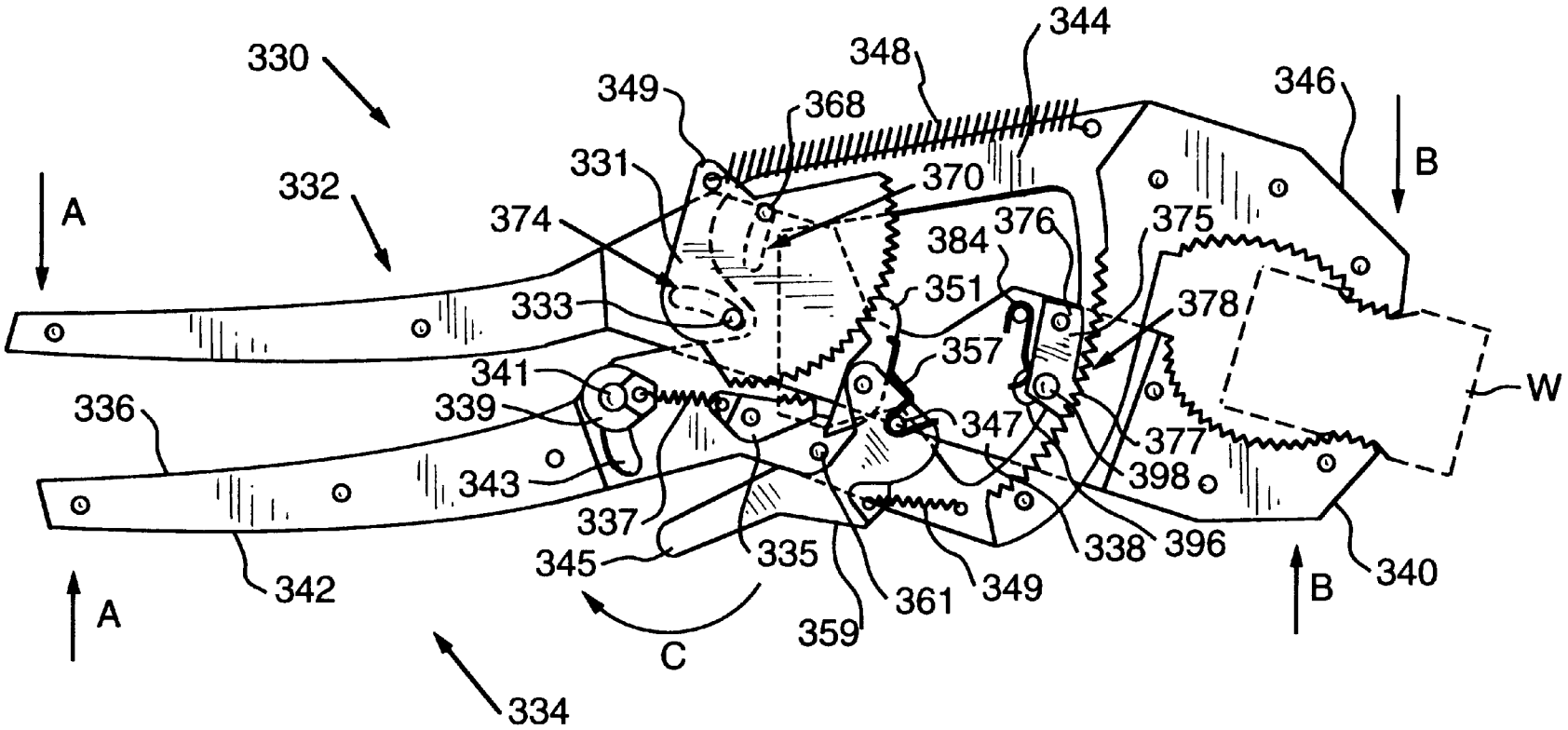
FIG. 22 is a further side elevational view of the pliers shown in FIGS. 18 and 19 illustrating the re-setting operation of the pliers.

With reference to FIG. 22, the release of the workpiece W by the jaw portions 340 and 346, as well as the re-setting of the pliers 330 will now be described in detail. To release the workpiece W, the user first moves the switch 339 to the upper portion of the lock slot 343 so that the switch 339 is in the unlocked position. This puts a spring bias on the lock pawl 335 biasing the lock pawl 335 away from the cam rack 331. However, at this point the lock pawl 335 will not actually disengage from the cam rack 331 because of the clamping force resting thereon. The user then squeezes the pump lever 345 just enough to relieve the force on the lock pawl 335, allowing it to be released from engagement with the cam rack 331. Now the entire clamping load rests on the pump pawl 351 and is held by the user's index finger just as during the initial clamping step previously described herein. As the pump lever 345 is gradually released, the combination of the energy stored in the compressed workpiece W, the flexure of the mechanism, and the bias of spring 348, forces the cam rack 331 to move in a clockwise direction carrying the engaged pump pawl 351 along also in a clockwise direction. When the bottom of the pump pawl 351 comes into contact with the release pin 361, release pin 361 cams the pump pawl 351 away from engagement with cam rack 331. Since both the lock pawl 335 and the pump pawl 351 are now disengaged from the cam rack 331, the spring 348 causes the cam rack 331 to be rotated back to its initial open position (FIG. 19). At this stage, the user can disengage the rachet pawl 375 from the rack 378 by manually operating the release pin 398 within the release slot 396 to release the rachet pawl 375 from engagement with the rack 378. This results in the pliers 330 being reset to their original, fully open starting position as shown in FIGS. 18 and 19. It should be appreciated that the locking pliers described herein can serve in a self-adjusting mode by keeping the lock pawl 335 permanently disengaged from the cam rack 331. In this mode of operation, any object can be freely grasped and clamped as long as hand pressure is applied to the handle portions 336 and 342 and then freely released by simply releasing the hand pressure on the handle portions 336 and 342 and releasing the pawl 375 with release pin 398.

With reference to FIGS. 23–26, a further embodiment of the invention is illustrated. In this embodiment there is set forth self-locking pliers 430 that do not include self-adjusting means as described in the previous embodiment. Otherwise, the self-locking mechanism is similar to the self-locking mechanism described for the pliers 330. It should be appreciated that pliers 430, shown in FIGS. 23–26, may be constructed similar to the pliers described herein. For example, the pliers may be formed of laminated construction in essentially the same manner as described for the previous plier embodiments set forth herein. It should also be appreciated that for simplicity and purposes of illustration, the pliers 430 shown in FIGS. 23–26 are shown with parts removed, such as, for example, outer laminations, so that the self-locking mechanism may be more clearly shown and described. It should also be appreciated that although only one side of the pliers 430 are shown in FIGS.

23–26, the opposing side of the pliers 430 is essentially identical thereto.

Figure 23:
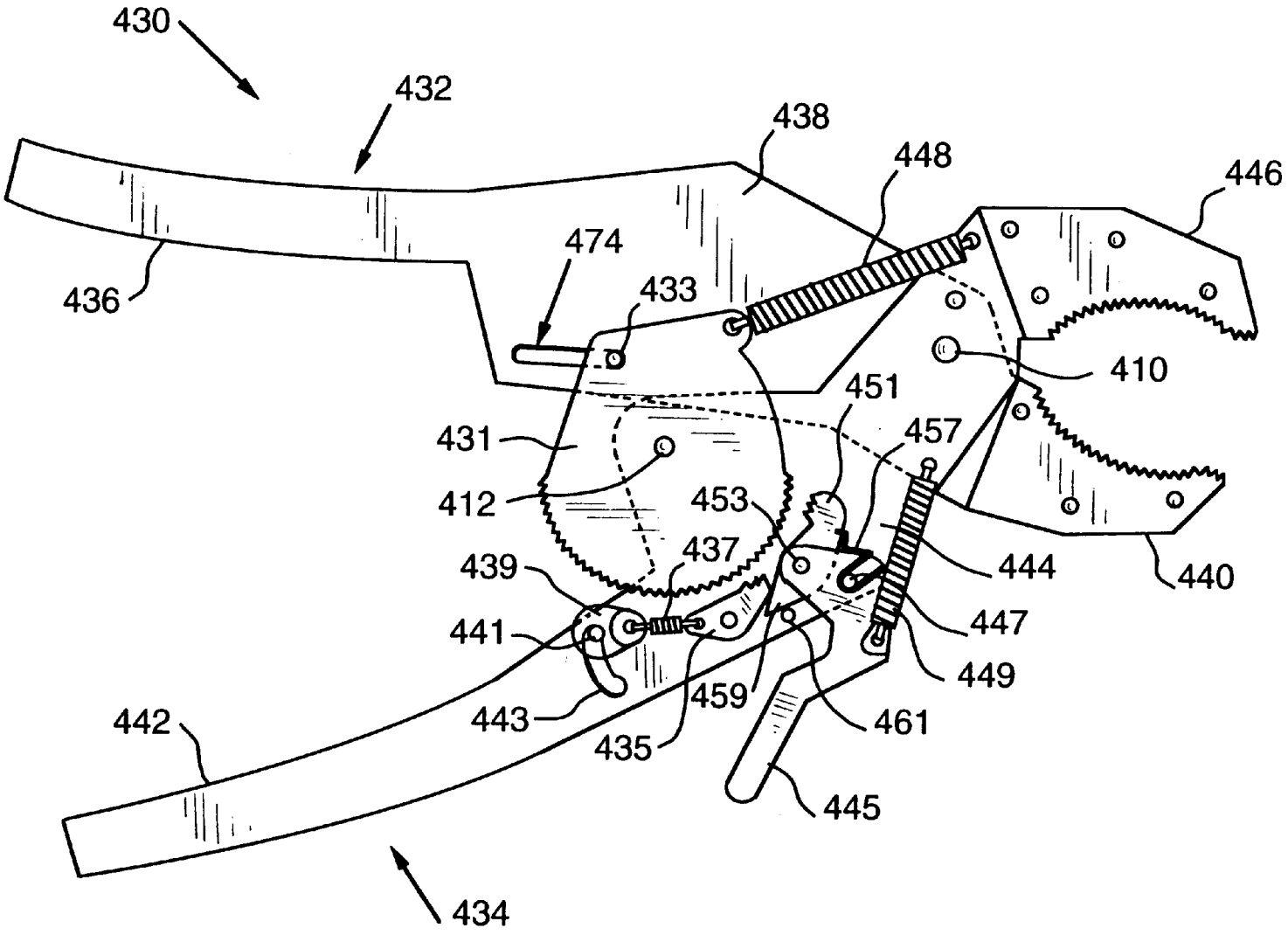
FIG. 23 is a side elevational view of still yet another embodiment of the present invention illustrating self-locking pliers in a fully open position.

With particular reference to FIG. 23, the structure of the pliers 430 will be described in more detail. The pliers 430 include a first plier member 432 and a second plier member 434 interconnected in a scissor like arrangement for providing a self-locking plier capable of locking the jaw portions into engagement with a workpiece, as will be described in detail. The first plier member 432 includes a handle portion 436, an intermediate portion 438 and a jaw portion 440. Similarly, the second plier member 434 includes a handle portion 442, an intermediate portion 444 and a jaw portion 446. The first plier member 432 is pivotally connected to the second plier member 434 by a fixed pivot pin 410 that extends through the intermediate portions 438 and 444 such that movement of the handle portions 436 and 442 toward each other will result in the jaw portions 440 and 446 also moving toward each other to grasp a workpiece.

Still referring to FIG. 23, the pliers 430 include a cam rack 431, having a plurality of teeth, attached to the intermediate portion 444 of the second plier member 434 by a pin 412 that extends through the cam rack 431 and through the intermediate portion 438. A cam pin 433 is permanently attached to the cam rack 441. The cam pin 433 is slidably received in a cam slot 474 which is formed in the intermediate portion 438 of the first plier member 432. It should be appreciated that the cam slot 474 is formed on both sides of the pliers 430. A spring 448, attached on one end to the cam rack 431 and on another end to the intermediate portion 444 of the second plier member 434, biases the cam rack 431 toward the jaw portion 446, i.e., in a clockwise direction about the pin 412. The bias provided by the spring 448 causes the cam rack 431 to rotate on pin 412 and also causes the cam pin 433 to impinge on the wall of the cam slot 474 which rotates the handle portion 436 around the pin 412 and causes the handle portions 436 and 442 to move toward the fully opened position, as shown in FIG. 23.

A lock pawl 435, having a plurality of teeth for engaging the plurality of teeth formed on the cam rack 431, is pivotally connected to the intermediate portion 444 of the second plier member 434 and is connected by a spring 437 to a switch 439 having a pin 441 that is slidably received in a lock slot 443. When the switch 439 is in the lower portion of the lock slot 443 (FIGS. 25 and 26) it causes the lock pawl 435 to be biased into engagement with the cam rack 431. When the switch 439 is in the upper position or upper portion of the lock slot 443 (FIGS. 23 and 24), it causes the lock pawl 435 to be biased toward disengagement from the cam rack 431.

A pump lever 445 is pinned to the intermediate portion 444 of the second plier member 434 by a pin 447. A spring 449 is connected on one end to the intermediate portion 444 and on the other end to the pump lever 445. The spring 449 biases the pump lever 445 toward an open or unactuated position, as shown in FIG. 23. A pump pawl 451, having a plurality of teeth for engaging the plurality of teeth formed on the cam rack 431, is pivotally connected by pin 453 to an upper end of the pump lever 445. A torsion spring 457 is mounted on pin 447 and engages the pump lever 445 and the pump pawl 451 and biases the pump pawl 451 toward the cam rack 431. A bottom end 459 of the pump pawl 451 rests against release pin 461 when the pump lever 445 is in the open position, as shown in FIG. 23. The engagement between the bottom end 459 of the pump pawl 451 and the release pin 461 resists the bias of the torsion spring 457 and maintains the pump pawl 451 out of engagement with the cam rack 431. As will be explained in more detail herein, actuation of the pump lever 445 will result in engagement between the pump pawl 451 and the cam rack 431.

Figure 24:
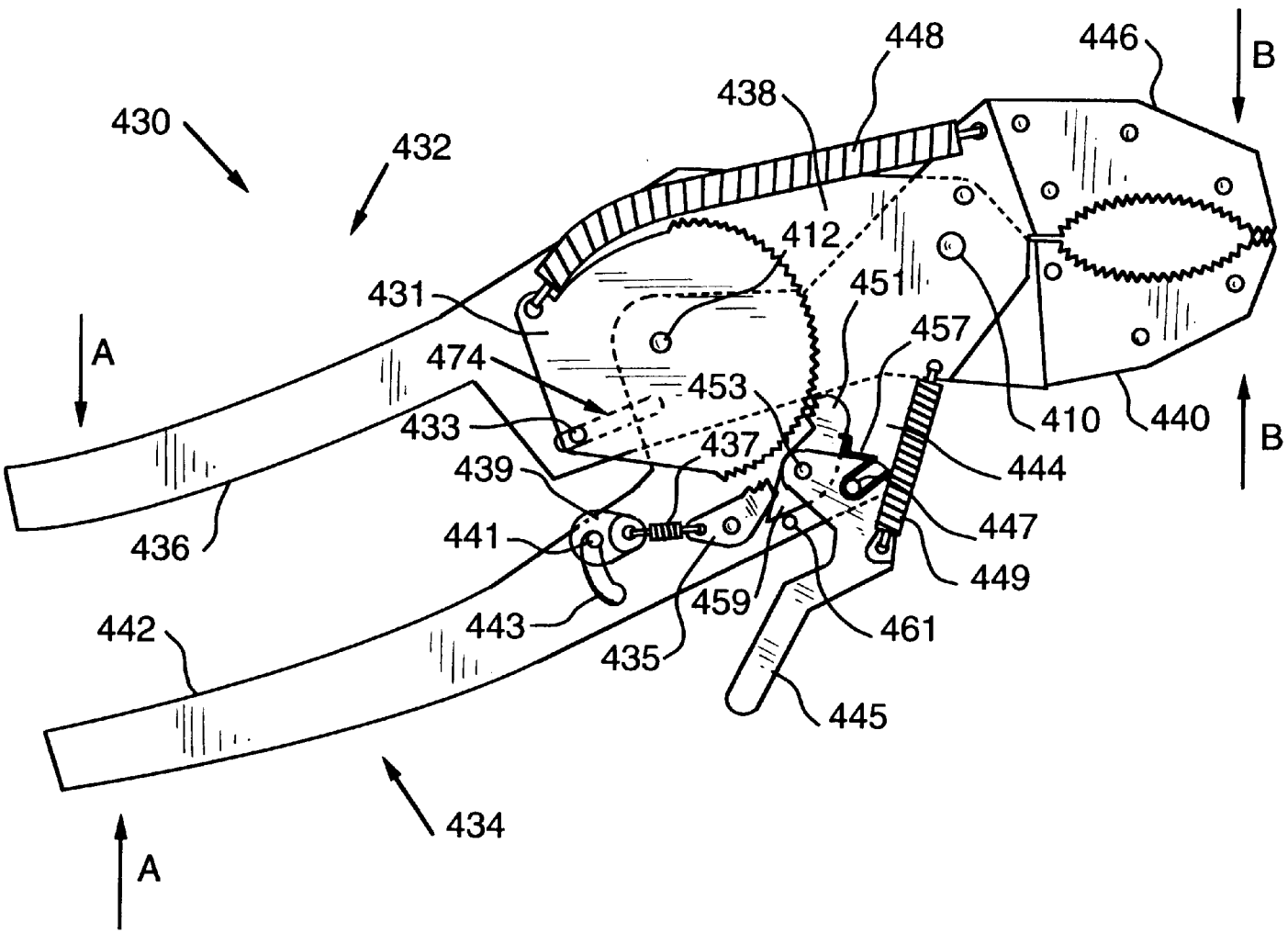
FIG. 24 is a further side elevational view of the pliers shown in FIG. 23 with the pliers in the fully closed position.
Figure 25:
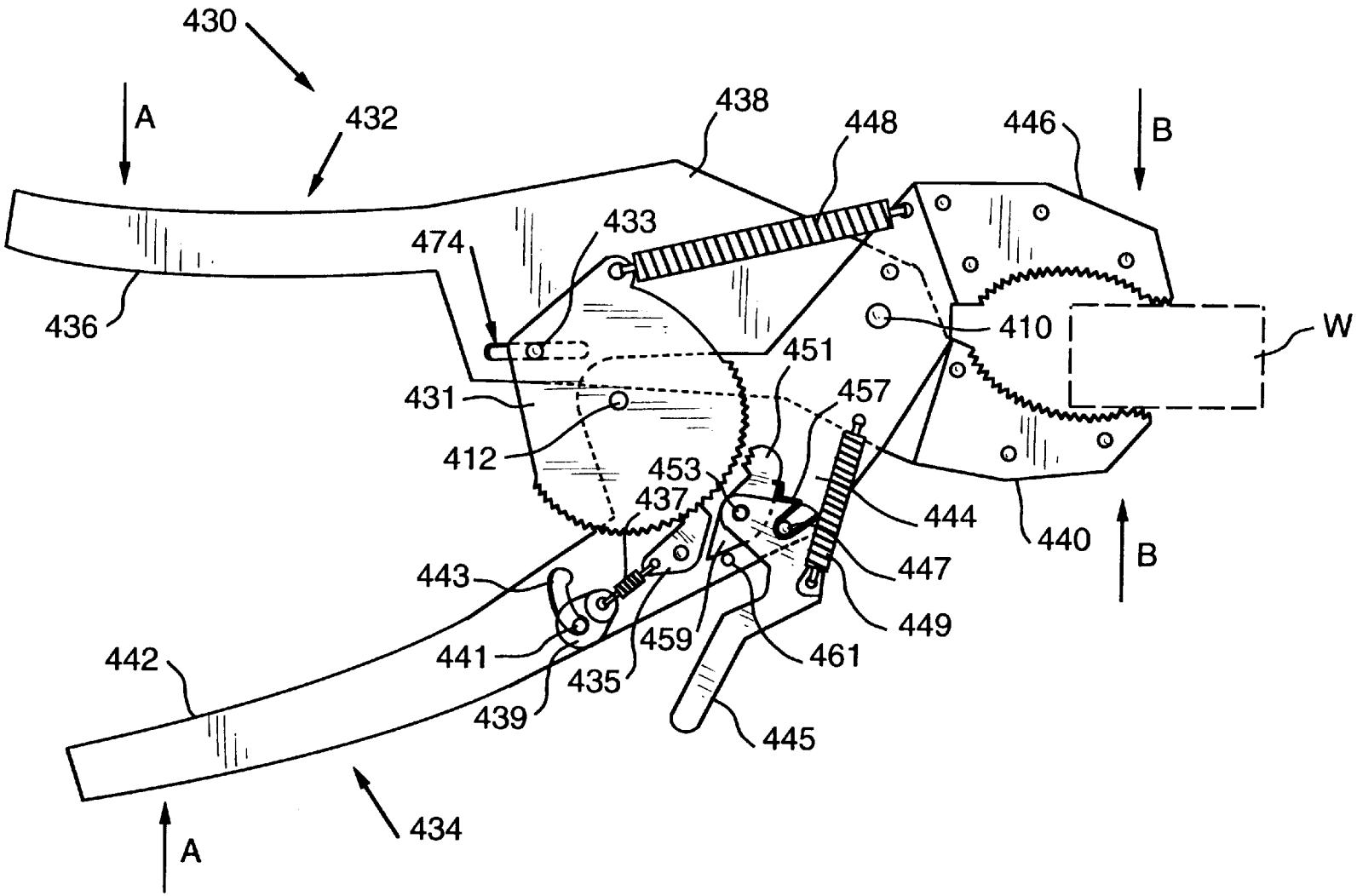
FIG. 25 is a further side elevational view of the pliers shown in FIG. 23 with the pliers shown as grasping a workpiece and being locked into engagement therewith.
Figure 26:
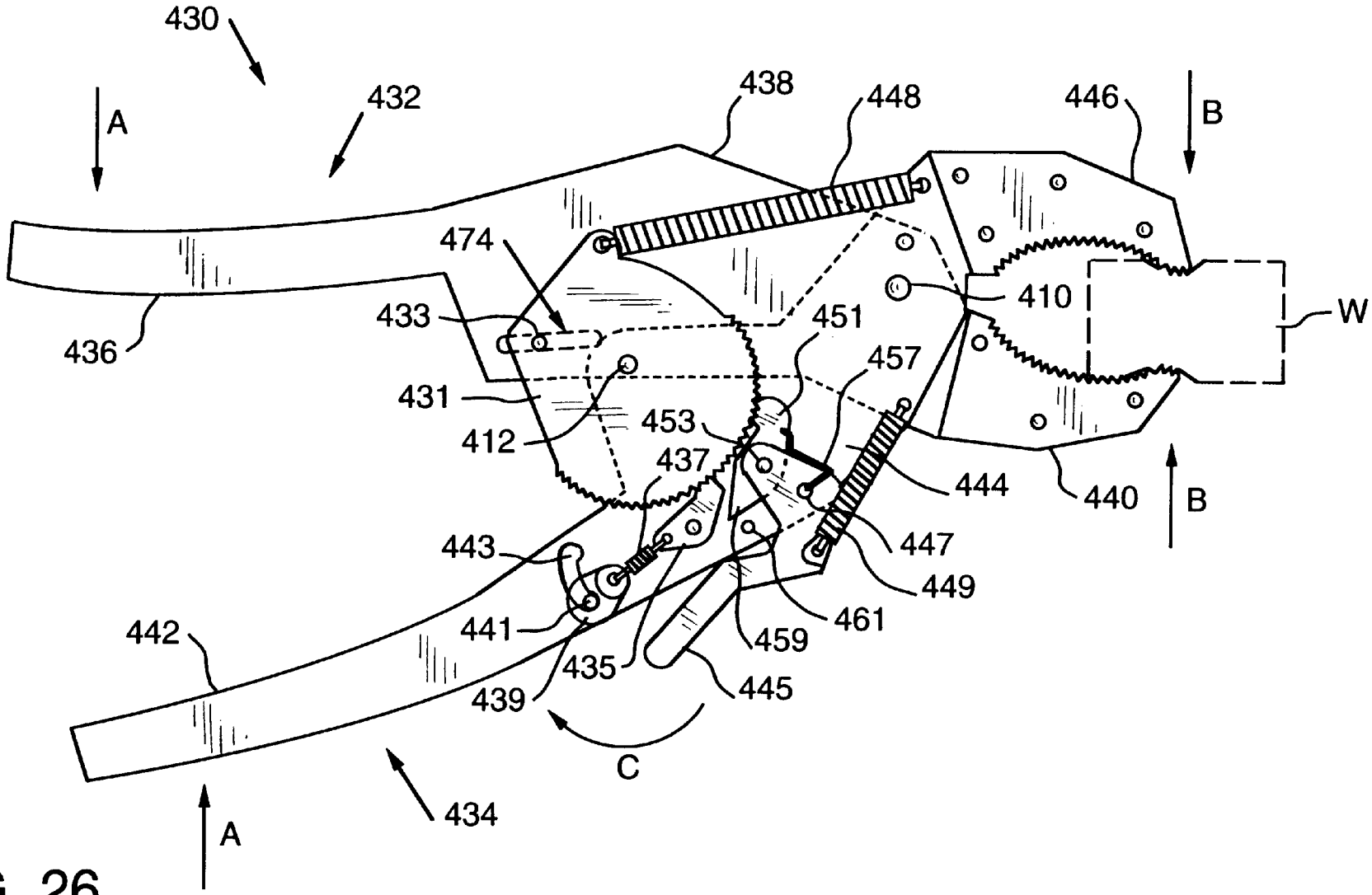
FIG. 26 is a further side elevational view of the pliers shown in FIG. 23 with the pliers shown as being locked into engagement with a workpiece and applying an additional clamping force thereto.

Referring particularly to FIGS. 24–26, the operation of the pliers 430 will be described in detail. As the user applies a force to the handle portions 436 and 442, the handle portions move in the direction indicated by arrows A and at the same time the jaw portions 440 and 446 move in the direction indicated by arrows B to grasp a workpiece W. During this movement, the handle portion 436 and the jaw portion 440 rotate about the fixed pivot pin 410 while the cam rack 431 rotates about the pin 412. As the jaw portions 440 and 446 begin to close down on the workpiece W, the spring 448 acts on the cam rack 431 with enough force to keep the first plier member 442 pulled in an upward direction to oppose the downward force being applied by the user to the handle portion 436 and 442. Continued movement of the handle portions 436 and 442 in a direction indicated by arrows A results in the spring 448 continuing to be extended providing counter pressure against the user's hand that is applying force to the handle portions 436 and 442. This causes the cam pin 433 to be forced along the cam slot 474. As shown in this embodiment, the cam slot 474 is essentially a straight or an elongated slot, whereas in the previous embodiment, the cam slot was generally arcuate. Therefore, it will be appreciated that the cam slot may be of various shapes depending upon the forced profile, as described, that is desired.

FIG. 24 shows the pliers 430 with the jaw portions 440 and 446 being fully squeezed together without a workpiece W therebetween. This Figures illustrates the rotation of the cam rack 431 and the position of the cam pin 433 within the cam slot 474 once the handle portions 436 and 442, as well as jaw portions 440 and 446, have been fully compressed by hand force. Also in FIG. 24, the lock pawl 435 and the switch 439 are in the open position so that the lock pawl 435 is not in engagement with the cam rack 431. Therefore, if pressure is released from the handle portions 436 and 442, the handle portions 436 and 442 and the jaw portions 440 and 446 will return to the fully open position as a result of the bias provided by spring 448 (see FIG. 23).

FIG. 25 shows the pliers 430 with a workpiece W positioned between the jaw portions 440 and 446. In this figure, the lock pawl 435 is in engagement with the cam rack 431 as a result of the switch 439 being in the locked position. Therefore, as pressure is applied to the handle portions 436 and 442 to cause the jaw portion 440 and 446 to grasp the workpiece, the cam rack 431 rotates and ratchets past the lock pawl 435 such that if pressure is released from the handle portions 436 and 442 the jaw portions 440 and 446 will remain locked into engagement with the workpiece W. This results from the cam rack being unable to rotate to its open position due to the contact with the lock pawl 435. Therefore, it will be appreciated that at this point in the operation of the pliers 430, the lock pawl 435 and the cam rack 431 are engaged balancing the load against the compressed workpiece W so that the pliers 430 will remain clamped to the workpiece W.

Referring to FIG. 26, further operation of the pliers 430 to apply additional clamping force to the workpiece W will be described. The pliers 430 are designed for one-handed operation. At this stage, the users hand that was applying the force or pressure to the handle portions 436 and 442 may be relaxed so that, for example, the index finger of the same hand can reach the pump lever 445. Repeated, trigger-like squeezing of the pump lever, i.e., rotation of the pump lever 445 in a clock wise direction (as indicated by arrow C), results in the application of the additional clamping force to the workpiece W as finger pressure is amplified by mechanical advantage. More specifically, triggering the spring biased pump lever 445 first swings the pump pawl 451 into engagement with the cam rack 431 thereby applying a rotational force to the cam rack 431 and forcing the handle portion 436 of the first plier member 432 downward due to movement of the cam pin 433 in the cam slot 474. If finger pressure on the pump lever 445 and pump pawl 451 is relaxed, the cam rack 431 rotation reverses minimally until blocked by the lock pawl 435. At this point, the pump pawl 451 retracts in relation to the cam rack 431. Repeated trigger action will incrementally rotate the cam rack 431 until the desired compression on the workpiece W has been achieved, or until the user's ability to compress the pump lever 445 has been exhausted. At this stage, maximum clamping force has been achieved and the pliers 430 can stay clamped or automatically locked to the workpiece W indefinitely. In accordance with an important aspect of this operation that results in the additional clamping force being applied to the workpiece W, the pump pawl 451 is biased toward engagement with the cam rack 431 by the torsion spring 457. However, the release pin 461 contacts the bottom end 459 of the pump pawl 451 when the pump lever 445 is in the unactuated position, as shown, for example, in FIG. 23. As the pump lever 445 is actuated in the clockwise direction, the pump pawl 451 is lifted away from the release pin 461 thereby allowing the torsion spring 457 to bias the pump pawl 451 into engagement with the cam rack 431, as shown in FIG. 26. Once the pump lever 445 returns to the unactuated position, the bottom end 459 of pump pawl 451, due to its curved shape, once again comes to rest against the release pin 461 with the pump pawl 451 being disengaged from the cam rack 431.

The re-setting operation of the pliers 430 is essentially the same as was described for pliers 330 herein. For example, to release the workpiece W the user first moves the switch 439 to the upper portion of the lock slot 443 so that the switch 439 is in the unlocked position. This puts a spring bias on the lock pawl 435 away from the cam rack 431. However, at this point the lock pawl 435 will not actually disengage from the cam rack 431 because of the clamping force resting thereon. The user then squeezes the pump lever 445 just enough to relieve the force on the lock pawl 435, allowing it to be released from engagement with the cam rack 431. Now the entire clamping load rests on the pump pawl 451 and is held by the users index finger just as during the initial clamping step previously described herein. As the pump lever 445 is gradually released, the combination of the energy stored in the compressed workpiece W, the flexure of the mechanism, and the bias of spring 448 forces the cam rack 431 to move in a clockwise direction currying the engaged pump pawl 451 along also in a clockwise direction. When the bottom of the pump pawl 451 comes into contact with the release pin 461, release pin 461 cams the pump paw 451 away from engagement with cam rack 431. Since both the lock pawl 435 and the pump pawl 451 are now disengaged from the cam rack 431, the spring 448 causes the cam rack 431 to be rotated back to its initial open position, as shown in FIG. 23.

It will be appreciated that the present invention provides an improved hand held utility plier capable of self-adjustment to grasp workpieces of different sizes and/or self-locking for locking the jaws of the pliers into engagement with a workpiece. The unique arrangement of pivot means in cooperation with the positioning slot and cam slot described herein, as well as the transferring or shifting of the pivot points during the operation of the pliers provides for an efficient and effective hand held utility plier that can be easily operated with one hand of the user. It will be appreciated that the arrangement of the particular pivot means may be varied in an assortment of ways in order to achieve the present invention and that the particular manner in which the invention has been described herein is only for illustration purposes. For example, the paired arrangements of slots and pins can be reversed by reversing directions of arcs and spring bias accordingly. Also, any of these springs described herein can generally be replaced by other forms of biasing means, such as other types of springs, resilient materials and other biasing means that are generally known in the art.

It will also be understood that descriptions of the invention herein relating to relative orientation of terms, such as, for example "upper" or "lower", "inner or outer", "top" or "bottom" are applicable to the figures and illustrations set forth herein but may be otherwise according to the particular orientation of the pliers and how the pliers are being applied.

It will also be appreciated that the present invention effectively provides for pliers that include the self-adjusting and self-locking mechanisms in combination, or providing for the self-locking and self-adjusting mechanisms individually.

Whereas particular embodiments of the present invention have been described herein for purposes of illustration, it will be evident to those skilled in the art that numerous variations of the details may be made without departing from the invention as defined in the appended claims.

What is claimed is:

1. Self-adjusting pliers for grasping a workpiece comprising:

first and second plier members each including a handle portion, a jaw portion, and an intermediate portion therebetween;

a first pivot on said intermediate portions permiting said jaw portions to converge on the workpiece and grasp the workpiece in response to initial pivotal movement of said handle portions toward each other;

said first pivot includes a first pivot pin attached to said intermediate portion of said second plier member and a positionig slot formed in said intermediate portion of said first plier mnember, said positioning slot having a generally arcuate portion and a shifting slot portion in comunication therewith;

said first pivot pin being slidably received in said positioning slot;

said first pivot pin is positioned in said shifting slot portion of said positioning slot during the initial pivotal movement of said handle portions toward each other to grasp the workpiece;

a second pivot on said intermediate portions permitting a further grasping force to be applied to the workpiece in response to continued pivotal movement of said handle portions toward each other;

said second pivot being closer to said jaw portions than said first pivot; and biasing means structured (a) for acting in cooperation with said first pivot to maintain said first pivot pin positioned in said shifting slot during the initial pivotal movement of said handle portions and (b) for biasing said handle portions away from each other and said jaw portions away from each other.

2. The self-adjusting pliers of claim 1 wherein said first pivot includes shifting means to terminate pivoting about said first pivot and initiate pivoting about said second pivot when said jaw portions grasp the workpiece.

3. The self-adjusting pliers of claim 2 wherein said second pivot means includes a second pivot pin attached to said intermediate portion of said first plier member and a generally arcuate main rack on said intermediate portion of said second plier member, said generally arcuate main rack having a plurality of notches, said second pivot pin in engagement with one of said plurality of notches of said generally arcuate main rack during the continued movement of said handle portions toward each other to apply the further grasping force to the workpiece.

4. At The self-adjusting pliers of claim 3 wherein said generally arcuate portion of said positioning slot has a curvature generally centered about said second pivot pin.

5. The self-adjusting pliers of claim 4 wherein said generally arcuate main rack has a curvature generally centered about said first pivot pin.

6. The self-adjusting pliers of claim 5 wherein said first pivot pin moves from said shifting slot portion of said positioning slot to said generally arcuate portion thereof when said second pivot pin is in engagement with said one of said plurality of notches of said generally arcuate main rack and during the continued movement of said handle portions toward each other to apply the further grasping force to the workpiece.

7. The self-adjusting pliers of claim 1 wherein said second pivot includes a translating pawl pivotally secured by a translating pawl pivot pin to said intermediate portion of said first plier member and a generally arcuate translating rack formed on said intermediate portion of said second plier member, said generally arcuate translating rack having a plurality of first teeth and said translating pawl having a plurality of second teeth formed on a first side thereof adjacent said generally arcuate translating rack, said plurality of second teeth in engagement with said plurality of first teeth of said generally arcuate translating rack during the continued movement of said handle portions toward each other to apply the further grasping force to the workpiece.

8. The self-adjusting pliers of claim 7 wherein said generally arcuate portion of said positioning slot has a curvature generally centered about said translating pawl pivot pin which pivotally secures said translating pawl to said intermediate portion of said first plier member.

9. The self-adjusting pliers of claim 8 wherein said generally arcuate translating rack has a curvature generally centered about said first pivot pin.

10. The self-adjusting pliers of claim 9 wherein said first pivot pin moves from said shifting slot portion of said positioning slot to said generally arcuate portion thereof when said plurality of second teeth of said translating pawl are in engagement with said plurality of first teeth of said generally arcuate translating rack and during the continued movement of said handle portions toward each other to apply the further grasping force to the workpiece.

11. The self-adjusting pliers of claim 7 wherein said second pivot further includes a stop member and a spring for urging said translating pawl into a concentric relationship with said generally arcuate translating rack, said stop member formed on said intermediate portion of said first plier member and positioned for contacting a second side of said translating pawl, said spring having one end connected to said intermediate portion of said first plier member and another end connected to said translating pawl for urging said translating pawl away from said generally arcuate traslating rack and into contact with said stop member.

12. Self-adjusting pliers for grasping a workpiece, said pliers comprising:

a first rigid member providing a first handle portion and a first jaw portion;

a second rigid member providing a second handle portion and a second jaw portion;

said first rigid member defining a generally arcuate rack having a plurality of teeth;

a pawl mounted to an intermediate portion of said second rigid member and positioned adjacent said arcuate rack;

one of said first and second rigid members carrying a pivot pin located rearwardly of said pawl, and the other of said first and second rigid members having an arcuate slot that receives said pivot pin;

a compression spring extending between said first and second rigid members, said compression spring having opposing first and second ends, the first end of said spring being connected to the first handle portion of said first rigid member and the second end of said spring being connected to the second handle portion of said second rigid member, said compression spring constructed and arranged to bias said first and second handle portions apart from one another so as to (1) bias said first and second jaw portions apart from one another to a fully opened position, and (2) bias said pivot pin towards one end of said slot, the bias of said spring restricting relative movement between said first and second rigid members during an initial manual movement of said first and second handle portions towards one another to pivotal movement by maintaining said pivot pin at said one end of said slot so as to enable pivotal movement of said first and second rigid members relative to one another about said pivot pin with said pivot pin remaining at said one end of said slot;

said pawl being positioned relative to said rack during said initial manual movement of said first and second handle portions towards one another causing said rigid members to pivot relative to one another as aforesaid, such that said pawl travels along an arcuate path in disengaged, spaced relation wilth respect to said arcuate rack, said pivot pin and said arcuate slot being constructed and arranged such that, after said first and second jaw portions engage the opposing sides of the workpiece continued manual movement of said first and second handle portions towards one another against the bias of said compression spring extending between said first and second rigid members causes said pivot pin to move away from said one end of said slot and causes engagement between said pawl and said arcuate rack, thus changing the pivot point of said first and second rigid members from said pivot pin to said pawl, so that continued application of manual force to said first and second handle portions toward one another after engagement of said pawl with said arcuate rack causes application of such force to said workpiece through said pivot point of said pawl.

13. Self-adjusting pliers according to claim 12, further including a spring connected with said pawl, wherein said spring is constructed and arranged to normally maintain said pawl in a predetermined pivotal position during said initial movement of said first and second handle portions toward one another such that a plurality of teeth formed on said pawl are disposed in a generally parallel facing relationship with said plurality of teeth formed on said first rigid member defining said generally arcuate rack, said pivotal position being a desired pivotal position for said plurality of teeth of said pawl relative to said plurality of teeth of said first rigid member during movement of said plurality of teeth of said pawl into engagement with said plurality of teeth of said first rigid member, thus facilitating engagement of said plurality of teeth of said pawl with said plurality of teeth of said first rigid member without requiring pivotal movement of said pawl.

14. Self-adjusting pliers according to claim 12, wherein said second rigid member comprises laminations disposed on opposite sides of said first rigid member so as to connect said first rigid member and said second rigid member to one another.

* * * * *